United States Patent [19]

Backstein et al.

[11] Patent Number: 4,478,149

[45] Date of Patent: Oct. 23, 1984

[54] UNDERWATER DETONATING DEVICE

[75] Inventors: Günter Backstein, Meerbusch; Hans W. Unger, Krefeld; Michael Günther; Dieter Kaltbeitzer, both of Duesseldorf, all of Fed. Rep. of Germany; Hendrik Veldhoen, Overijse, Belgium

[73] Assignee: Rheinmetall GmbH., Duesseldorf, Fed. Rep. of Germany

[21] Appl. No.: 424,248

[22] Filed: Sep. 27, 1982

Related U.S. Application Data

[62] Division of Ser. No. 190,420, Sep. 24, 1980, Pat. No. 4,369,709.

[30] Foreign Application Priority Data

Sep. 29, 1979 [DE] Fed. Rep. of Germany ..... 2939711
Sep. 29, 1979 [DE] Fed. Rep. of Germany ..... 2939700

[51] Int. Cl.[3] ..... F42C 15/40
[52] U.S. Cl. ..... 102/426; 102/215
[58] Field of Search ..... 102/215, 416, 418, 419, 102/420, 426, 427

[56] References Cited

U.S. PATENT DOCUMENTS

| | | | |
|---|---|---|---|
| 3,030,885 | 4/1962 | Mounce et al. | 102/418 |
| 3,572,244 | 3/1971 | Garber | 102/418 |
| 4,026,215 | 5/1977 | Ziemba et al. | 102/215 |
| 4,038,901 | 8/1977 | Backstein | 89/1 B |

*Primary Examiner*—Stephen C. Bentley

[57] ABSTRACT

An underwater ignition device is provided comprising a rotor, a detonator disposed at the rotor, a locking pin secured in position by a safety pin, a release pin maintained in position by the locking pin, a first water pressure safety device normally engaging the rotor and preventing a rotating motion of the rotor into an ignition position and a second water pressure safety device actuable after the locking pin is removed and after the first water pressure safety device has been actuated and capable of actuating the release pin for rotating the rotor into an ignition position. An ignition circuit employed comprises a digital logic connected to an analog receiver, dual driver stages connected to the digital logic, parallel discharge circuits connected to the dual driver stages and to a detonator and the voltage supply and suitable for selectively igniting the detonator or for short circuiting the voltage supply. The digital logic actuates two discharge circuits in successive time intervals ($t_1$, $t_2$, $t_3$) depending on two frequency and time correlated input signals.

7 Claims, 17 Drawing Figures

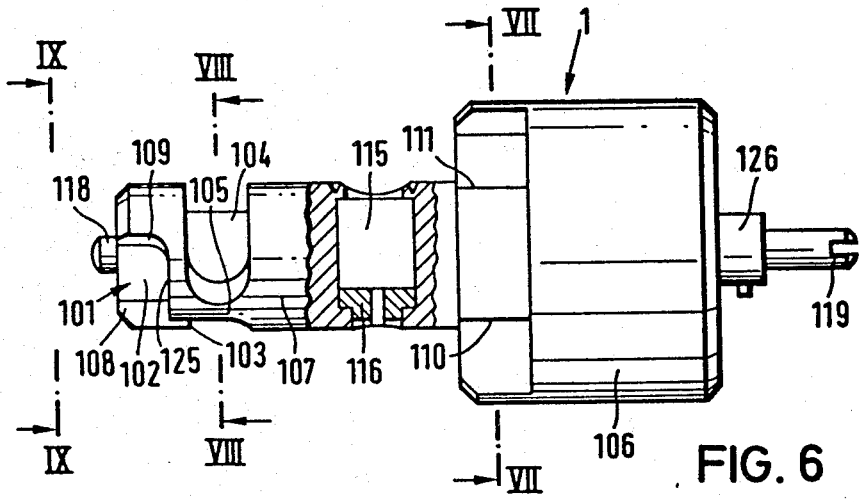
FIG. 6
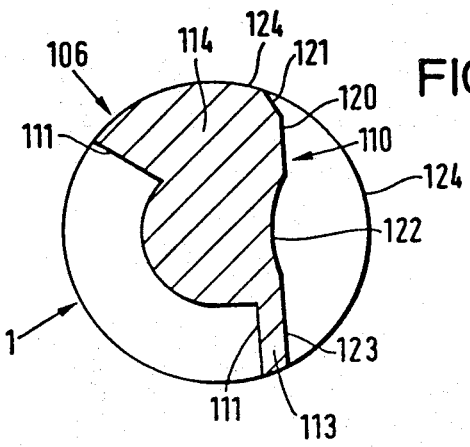
FIG. 7
FIG. 8
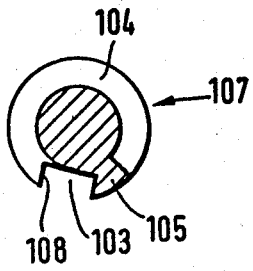
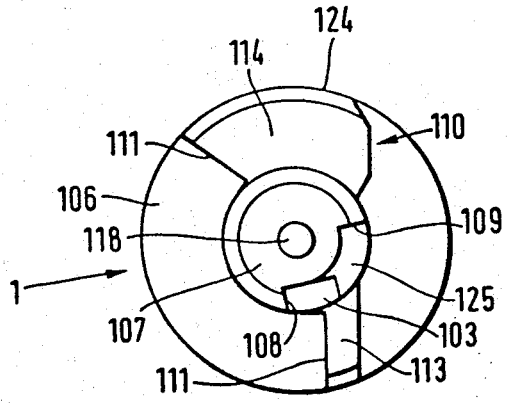
FIG. 9

UNDERWATER DETONATING DEVICE

This application is a division of application Ser. No. 190,420, filed Sept. 24, 1980 now U.S. Pat. No. 4,369,709.

BACKGROUND OF THE INVENTION

The invention pertains to an underwater detonating device for igniting explosive charges, comprising at least two independent safety provisions as two water pressure safety devices and a locking pin safety arrangement with a rotor carrying a detonator, which rotor can only be moved into a live position by release through a controlled sequence of steps.

Backstein in U.S. Pat. No. 4,038,901 issued Aug. 2, 1977 discloses a submergible detonating device, which can be pulled by a tow cable, and a detonator gripper is employed for underwater cutting of anchor chains of sea mines or the like. The detonating device is provided with a release plate to be actuated by the anchor chain, and upon impact with a sufficiently high mechanical pressure the plate punches through a shear safety arrangement and thus releases the ignition mechanism, if previously the water pressure safety device had been actuated and had released an ignition needle blockage.

The known arrangement thus is provided with three safety provisions, which are to be actuated in the cited sequence for releasing the ignition, that is, a cutter pin safety device not itself secured for the release plate, a water pressure safety device for the ignition needle, as well as a shearing force safety devie, the release of which by mechanical forces directly results in starting the ignition.

It appears to be clear that such an underwater ignition device is well adapted as a detonator gripper pulled by a tow cable for the sweeping of mines; however, it cannot be employed directly for all possible tasks of explosive charges, wherein mechanical pressure action is undesired or not possible for any reasons.

SUMMARY OF THE INVENTION

The present invention has as its principal object to provide an underwater detonating device of the kind cited above such that the ignition arrangement comprises as successively to be actuated safety devices for the controlled sequence release: a safety pin with warning flag for a locking pin; a first water pressure safety device, which blocks a rotational motion of the rotor into ignition position, a locking pin; which blocks every motion of a release pin; and a second water pressure safety device, which blocks a shifting of the release pin and blocks a rotation of the rotor into the ignition position and which operates independently from the first water pressure safety device.

The underwater ignition device comprises a rotor; a detonator disposed at the rotor, a safety pin; a locking pin secured in position by the safety pin; a release pin maintained in position by the locking pin; a first water pressure safety device normally engaging the rotor and preventing a rotating motion of the rotor into an ignition position; and a second water pressure safety device actuable after the locking pin is removed and after the first water pressure safety device has been actuated and capable of actuating the release pin for rotating the rotor into an ignition position.

The first water pressure safety device can be actuated by impact of water pressure through a first membrane against the force of a first spring, and preferably the first water pressure safety device comprises a slidable piston having a cross protruding guide pin engaging a guide groove of the rotor, and the pin being movable in the guide groove. The guide groove of the rotor can be provided with an external ring and a separate internal ring, and the external and internal rings can be connected by an axial recess of the rotor. The external ring can form a dummy setting groove and the internal ring can form a live setting groove, and the axial recess can be the connection between them. Preferably, the external ring and the internal ring of the guide groove extend in opposite directions of the circumference of the rotor and in each case form a path of an arc of a circle limited by stops. The guide pin of the piston of the first water pressure safety device can only be moved axially in an aligned position with the axial recess towards and into the live setting groove upon actuation of the piston and the first membrane by a sufficient water pressure. Preferably, the rotor is prestressed by a spring, which upon release of the release pin in air rotates the rotor such that the piston impacted by insufficient water pressure moves with its guide pin in the external ring of the guide groove into a dummy position and blocks against an axial motion upon a successive pressure increase at the first membrane.

The rotor can be provided with stops which limit its rotational motion in both circumferential directions. The release pin can be provided at one end with a peripheral groove running cross to its axis, and the support of the release pin can be provided with corresponding bore holes for sealingly accepting the inserted locking pin. The locking pin can be provided with an eye on its end passed through the release pin, which eye receives the safety pin having a warning flag and the other end of the locking pin can be connected to a pull cable. Bore holes in the support of the pin can form entrance openings for water with small cross-sections upon removal of the locking pin for impacting a second membrane and a second piston of the second water preseure device. The release pin in rest position at its end opposite to the locking pin and cross to the axis of the rotor preferably engages off-center with the seat surface of the rotor and the release pin only upon sufficiently large water pressure acting upon the second membrane exerts a rotary force on the rotor, which overcomes the prestress of the rotor and rotates the rotor into the ignition position. The spring force of a spring prestressing the rotor can be adjustable for selecting the water pressure required for release of the second water pressure safety device. The spring can be formed as a spiral spring and disposed in a spring case with the number of rotations of the spring case versus the housing of the ignitor determining the spring force of the spring. Upon insufficient water pressure the spring can rotate the rotor upon release of the release pin and push the release pin out such that the front end of the release pin slides over a bevel on the outer circumference of the rotor body and disengages from the seat surface. The seat surface of the rotor can be disposed off-center and be provided with two plane regions which are connected via a cylindrical recess, while a bevel runs under a reflex angle from a plane region to the outer circumference of the rotor.

A second piston of the second water pressure safety device can simultaneously actuate a switch for the ignition circuit upon shifting of the second piston and of the release pin, which rotates the rotor into ignition position. A contact pin can be impacted by a pressure spring which rests against the rotor shaft, and which only upon full rotation of the rotor penetrates into the detonator and provides the ignition contact.

The underwater ignition device can further comprise an analog receiver, a digital logic connected to the analog receiver, dual driver stages connected to the digital logic, parallel discharge circuits connected to the dual driver stages and to the detonator and the voltage supply and suitable for selectively igniting the detonator or for short-circuiting the voltage supply. The digital logic preferably actuates two discharge circuits in successive time intervals ($t_1$,$t_2$,$t_3$) depending on two frequency and time correlated input signals.

Also there is provided a control system for sound actuation or pressure pulse actuation of ignition devices which comprises an analog pressure wave receiver, a digital logic connected to the analog receiver, dual driver stages connected to the digital logic, parallel discharge circuits connected to the dual driver stages and to a detonator and a voltage supply and suitable for selectively igniting the detonator or for short-circuiting the voltage supply. The digital logic actuates two discharge circuits in successive time intervals ($t_1$,$t_2$,$t_3$) depending on two frequency and time correlated input signals.

The underwater ignition device comprising analog receiver and digital logic and the control system for sound or pressure pulse actuation can comprise additional or specific elements as follows, or can be constructed to perform certain functions. The analog receiver can comprise a hydrophone, a preamplifier connected to the hydrophone, a band-pass filter connected to the preamplifier, a buffer amplifier connected to the band-pass filter, and two parallel selective filters connected to the buffer amplifier and having outputs with logic level for processing in the digital logic part. The analog receiver can comprise two parallel selective filters, which have in their filter channel in each case in series connection a filter element, an emitter follower and a Schmitt-trigger. The selective filters can be decoupled via two resistors and can be provided with piezoelectrical tuning fork filters capable of maintaining the impressed resonance frequency to 1 hertz accuracy.

The digital logic can comprise a control signal generator for zero positioning of the time switching, and a digital time base for generating time dependent pulses and a time window for scanning of time and frequency correlated, coded receiver signals. The digital logic can have output stages comprising two parallel driver stages, which in each case control a thyristor for igniting the detonator or for separating the supply voltage and for discharging the battery. The digital logic can also comprise a divider and a connecting logic connected to the divider for successively in a first time interval ($t_1$) blocking the two discharge units, in a second time interval ($t_2$) releasing the detonator ignition circuit and blocking the battery discharge circuit, and in a third time interval ($t_3$) separating the detonator ignition circuit and the analog receiver part and discharging the battery. The ignition circuit can be connected to the supply voltage through a switch of a water pressure safety device and upon closure of the switch the digital logic part can take a defined starting state and begin a dead time of the first time interval ($t_1$). The outputs of the digital logic part can be connected in each case with a gate electrode of thyristors and these connect through in the presence of a predetermined output signal. The gate electrode of the ignition thyristor for the detonator can be connected to a transistor, which at the switch-on time of the ignitor forms a short-circuit bridge and thus excludes a connecting through of the ignition thyristor. Preferably, the digital logic comprises C-MOS devices and the analog receiver, the digital logic and the driver stages are powered by a supply voltage from a lithium battery.

There is also provided a method for underwater ignition of an explosive charge comprising removing a safety pin from a locking pin of an explosive device, placing the explosive device under water, actuating a first water pressure safety device by the external pressure generated by the water at a certain depth, removing with a pull cable the locking pin, actuating a second water pressure safety device by the external water flowing under pressure through openings left by the removal of the locking pin, shifting a release pin by way of actuation of the second water pressure safety device and rotating a rotor by the released motion of the release pin into an ignition position.

The actuation of the second water pressure safety device can provide for closing of an ignition circuit. The ignition circuit can be further controlled by pressure signals received with a hydrophone. The timing of the ignition circuit can be separated into a first dead time, a second live time and a third, battery discharge time.

The underwater ignition device of the present invention provides advantageously a particularly safe arrangement comprising four independently operating mechanical safety provisions, which all have to be released in the sequence required by the construction of the apparatus in order to allow ignition to occur. Even when all four safety devices have been released no automatic ignition of the explosive charge occurs, since for this purpose also an ignition pulse has to be provided by the electronic part of the underwater ignition device. This allows for additional possibilities of safeguarding, since only special signals are capable to induce the electronic to release the igniting pulse.

In connection with the elimination of the mechanical pressure release, an increased safety is achieved by employing a second water pressure safety device operating at a higher water pressure compared with the first water pressure safety device. The logical connection of mechanical steps made possible thereby assures that the mechanics of the ignition devices releases only when the functional steps occur in the sequence required by the construction.

In case the underwater ignition device is not released in the predetermined sequence of its safety arrangements, then an ignition of the ignition device is excluded. For example, when the safety pin is not removed before the introduction of the underwater ignition device under water, then the first water pressure safety device can operate and release the coordinated end of the rotor; however, even with a water pressure sufficient for the second water pressure safety device, the rotor remains in its rest position, since the safety pin has not been pulled out and therefore the locking pin cannot be actuated.

When the safety pin is properly removed and the locking pin is pulled in air or in too low a water depth, then again ignition is prevented, since the spring loaded rotor rotates around its axis in such a way that, on the one hand, the guide pin of the first water pressure safety device runs into its dummy position and, on the other hand, the release pin is pushed out and comes to rest against the outer surface of the rotor, where it cannot provide any rotation by impacting on the rotor. This means that in such a case an irreversible blind position has been reached, from which the rotor cannot be removed even when the igniter thereafter is exposed successively to by itself suitable water pressures.

The invention accordingly consists in the features of construction, combination of elements, arrangement of parts and series of steps which will be exemplified in the device and method hereinafter described, and of which the scope of application will be indicated in the appended claims.

BRIEF DESCRIPTION OF THE DRAWING

In order that the invention may be readily carried into effect, it will now be described with reference to the accompanying drawings, wherein:

FIG. 6 is a side view, partially in section, of the rotor;

FIG. 7 is a sectional view of the rotor along the plane VII—VII of FIG. 6;

FIG. 8 is a sectional view of the rotor along the section line VIII—VIII of FIG. 6;

FIG. 9 is a plan view of the rotor in axial direction along the lines IX—IX of FIG. 6;

Figure 1:
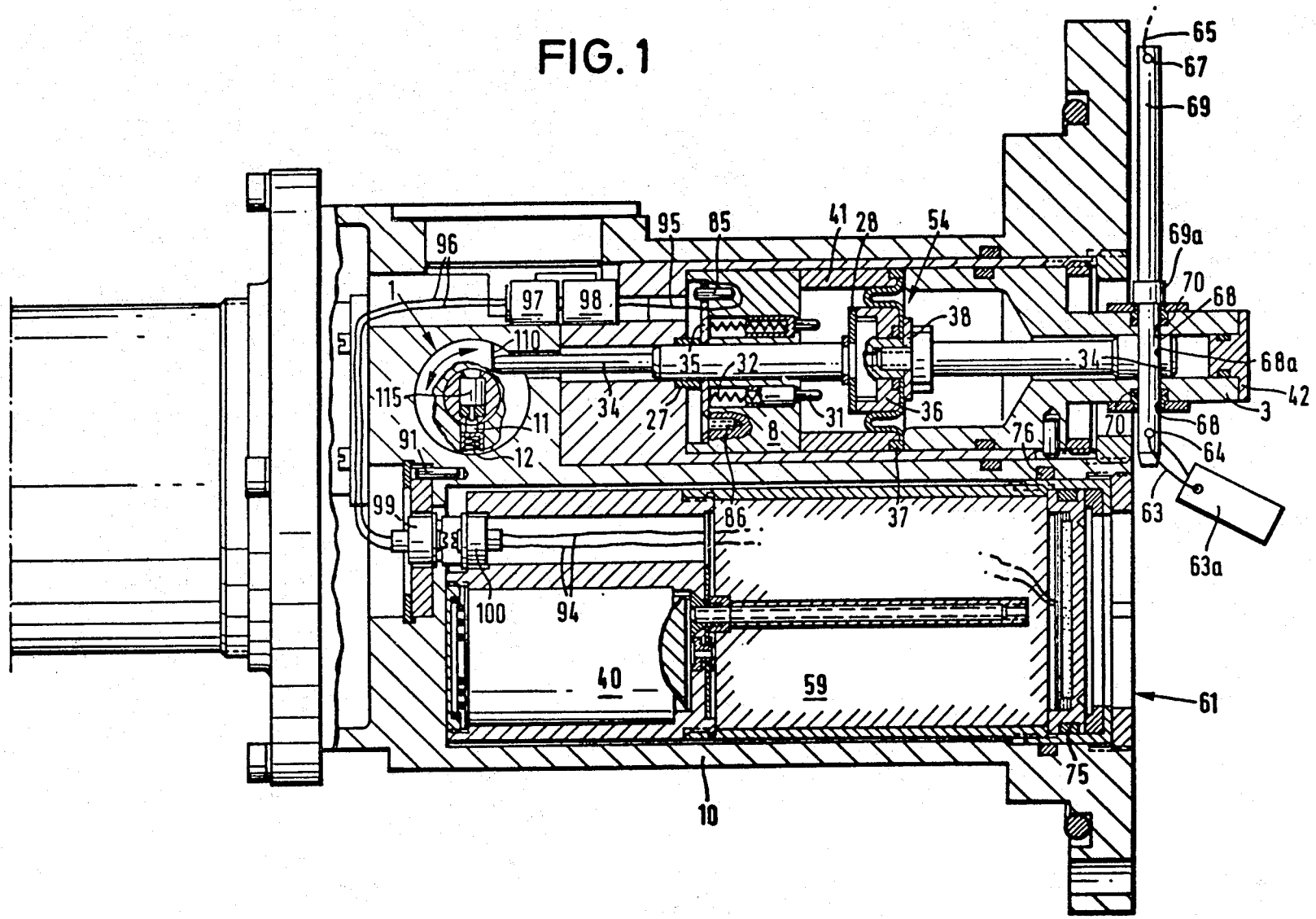
FIG. 1 is a side elevational view of the underwater ignition device, partially in section.

Table 1 is a truth table for illustrating the functioning of the input decoder IC4A and of the time base decoder IC4B;

Table 2 is a presentation of frequencies and times, which are tapped at the divider chain IC6 and IC7; and Table 3 is a presentation of the time ranges at the output of the time base decoder.

DETAILED DESCRIPTION

Construction of the Ignition Device

The complete ignition device is disposed in a housing 10 and comprises as main elements besides the electronic plug-in module 59 a first water pressure safety device 44, a second water pressure safety device 54, a locking pin 69, a release pin 34, a rotor 1 with a detonator 115, a contact pin 25, a container 5, a booster charge 6 as well as the main charge 7.

The front side of the housing 10 shows a locking piece 3 providing support for the release pin 34 and the locking pin 69. The locking piece is attached to the housing by a sealing connection. The locking piece 3 is tube shaped and at its front end closed with a sealing closure 42. Across the axis of the locking piece 3 there are provided two aligned bore holes 68 passing through the locking piece 3 and capable of receiving O-rings as seals 70. A corresponding peripheral groove **68*a* at the release pin 34 is in the rest position of the igniter aligned with the bore holes 68 such that the locking pin 69** can be slid through.

In the construction according to FIG. 1, the locking pin 69 can be seen as passed through the bore holes 68 and supported with a collar **69*a* at the locking piece 3. The locking pin 69 is provided at its lower end with an eye 64, which receives a safety pin 63 having a warning flag 63*a* and which safety pin 63 prevents a pulling out of the locking pin 69. At the upper end of the locking pin 69 there is provided an eye 67 for attachment of the pull cable 65, which is employed in pulling out the locking pin after the safety pin 63** has been removed.

The release piston 34 is at its middle region mounted at the piston 36 of the second water pressure safety device 54, which is provided with an elastic second membrane 37, which is mounted at the piston 36 with a disc 38. Preferably, the membrane 37 is formed as a roll membrane and attached with its circumference to a tube 41. The piston 36 carries a plate 28 at its side towards the rotor 1. The plate 28 is provided for engaging two pairs of contact pins 31 and forms with these a switch for the electrical part of the ignition device. This switch comprising contact pins 31 and plate 28 can, for example, be connected via conduits 95, plug connectors 97 and 98, conduits 96, plug connectors 99 and 100 as well as conduits 94 for closing the ignition circuit and can be connected to the schematically represented electronic plug-in module 59, as cam well as provide for a voltage supply via a battery 40. The electrical conduits are disposed in the housing with insulation and a releasable closure 61 is provided with seals 75 and 76 allows access to the electronic plug-in module 59 and the battery 40. A precondition for the closure of the electrical ignition circuit is, however, to abide by to the sequence predetermined by the construction of actuating the individual safety devices of the ignition, since the plate 28 closing the contact pins 31 is part of the second water pressure safety device 54, which is the last safety device actuated of all safety devices.

Figure 3:
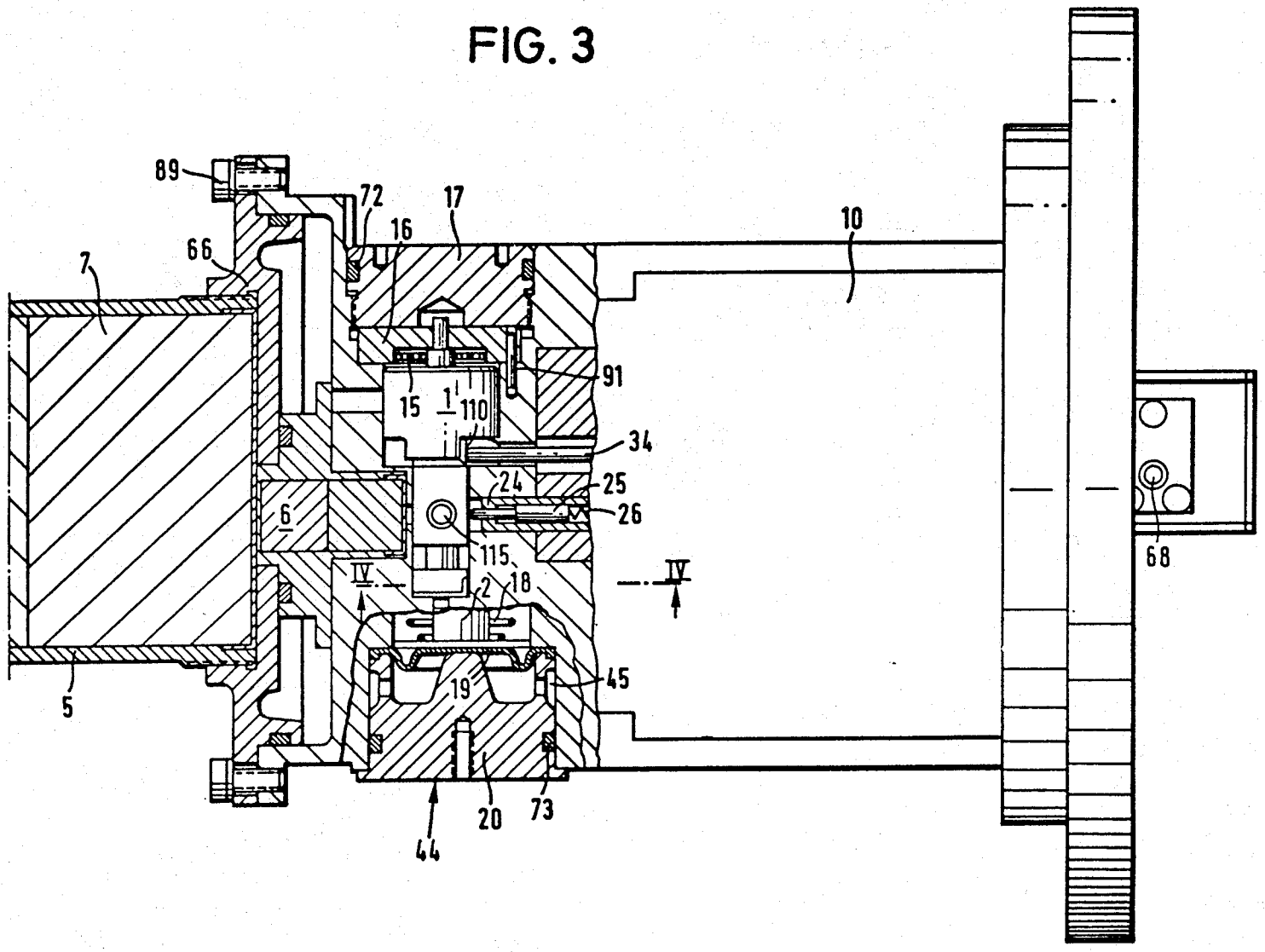
FIG. 3 is a further side view of the underwater ignition device, partially in section along a plane running vertical to the plane of FIG. 1.

As can be seen from FIGS. 1 and 3 the rotor 1 engages with its seat surface 110 the release pin 34. In the rest position shown in FIG. 1 the detonator 115 is short-circuited via a contact pin 11, which is prestressed by a pressure spring 12 for electromagnetic compatibility. This short-circuit bridge is opened upon rotation of the rotor 1 by about 90° into its ignition position. Similarly, in the arrangement shown in FIG. 3 the contact pin 25 disposed in an isolating sleeve 24 presses against the rotor shaft 107 and is short-circuited via the same.

The rotor 1 itself is rotatably supported via its upper and lower bearing shafts 119 and 118, respectively, and these bearing shafts provide for low friction. At its upper end, the rotor 1 is provided with a spiral spring 15, which is disposed in a spring case 16, which in turn is supported by a rotor closure cap 17 solidly inserted into the housing 10 with a seal 72. The spiral spring 15 attached to the rotor 1 and to the spring case 16 prebiases the rotor in clockwise direction, wherein the number of rotations of the spring case 16 lockable with a pin 91 determines the pretensioning force of the spiral spring 15, which presses the same against the release pin 34 and counteracts to a rotation of the rotor 1 into the ignition position.

The release pin 34 is thus in rest position clamped between the seat surface 110 of the pretensioned rotor 1 and the passed through locking pin 69. In order to rotate the rotor 1 into the ignition position in the presence of sufficient water pressure and when the locking pin 69 is removed, the force exerted by the spiral spring 15 has to be overcome such that the water depth can be predetermined with the pretension of the spiral spring 15, at which depth the ignition can be turned live, since the water pressure increases uniformly with the depth.

Figure 2:
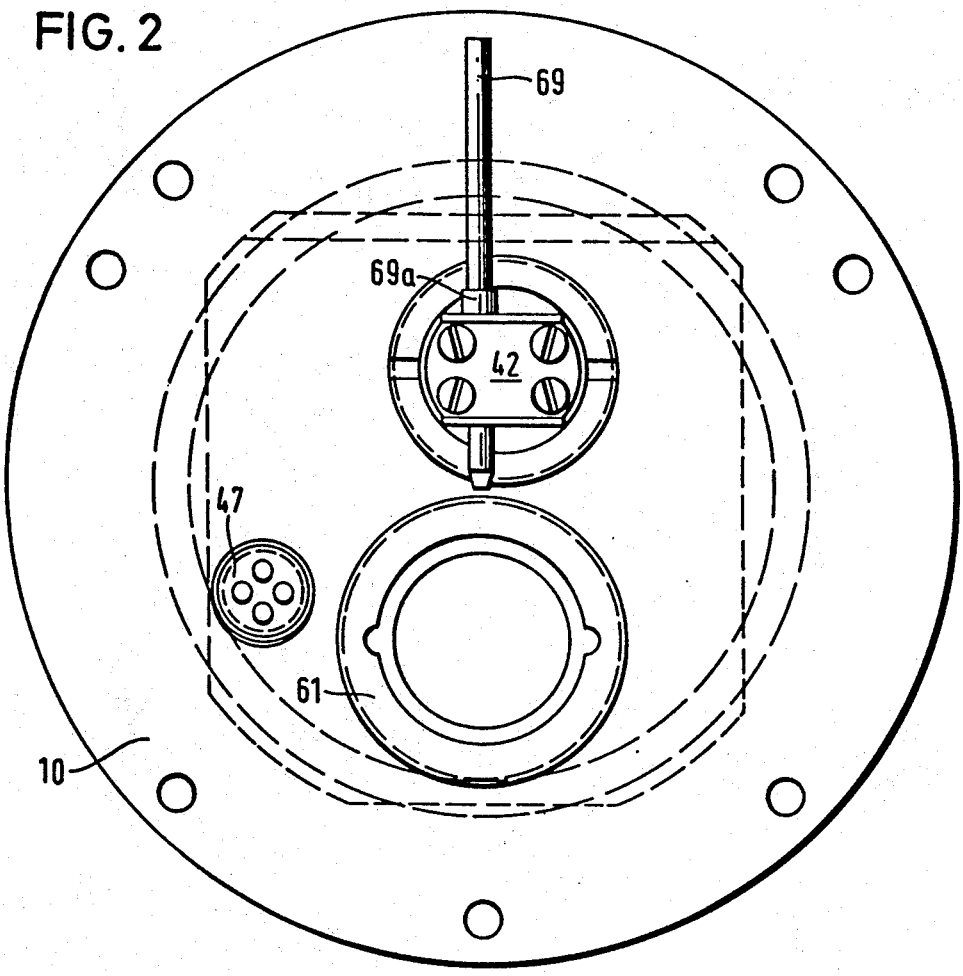
FIG. 2 is a side view of the underwater ignition device from the right.

The first water pressure safety device 44 can be recognized in FIG. 3. The water pressure safety device 44 is connected to a sieve 47 (FIG. 2) via passages 45 having a slight inclination. Through the sieve 47 and the passages 45 water can impact the first membrane 19, which is prestressed with a conical spring 18 surrounding the piston 2 towards the outside. The membrane 19 is terminated towards the outside with a cap 20, which is sealed with a seal 73.

At the side opposite to the locking pin 69 the main charge 7 surrounded by a jacket 5 can be recognized. The main charge 7 is attached to the housing 10 with bolts 89 and a sealed cover 66. The booster 6 is ignited in the ignition position of the rotor by the detonator 115.

Figure 4:
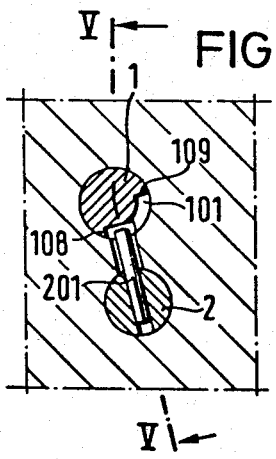
FIG. 4 is a section through the rotor and piston of the second water pressure safety device along the section line IV—IV of FIG. 3.
Figure 5:
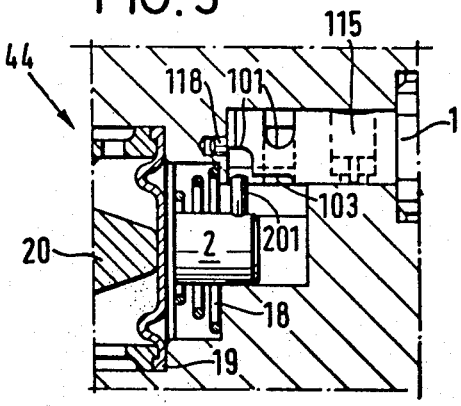
FIG. 5 is a sectional view of the rotor and the piston of the second water pressure safety device along the section line V—V of FIG. 4.

The coacting of the piston 2 of the first water pressure safety device 44 with the rotor 1 is shown in more detail in FIGS. 4 and 5. The piston 2 is provided at its upper side with a, transverse to the outside, protruding, radical guide pin 201, which engages the guide groove 101 of the rotor 1 and which is slidable in said groove. The rotor 1 itself is shown in detail in FIGS. 6 to 9. Next to the upper bearing pin 119 is disposed a cylinder part 126 around which the spiral spring 15 is wound. A cylinder shaped rotor body 106 of larger diameter follows. As can be seen from the section of the rotor body 106 shown in FIG. 7 from the middle, massive region of the rotor body 106 two asymmetrical protrusions 113 and 114 extend towards the outside to the outer circumference 124 of the rotor body 106. These protrusions 113 and 114 form on the one side stops 111 for engaging a pin (not shown) and limit the rotational motion of the rotor 1. On the other hand the protrusions 113 and 114 form the above mentioned seat surface 110 for the release pin 34. This seat surface 110 comprises two straight line regions 120 and 123 which are connected via an arc shaped recess 122, and the straight line region 120 is followed with a bevel 121 forming a reflex angle with the line, said bevel 121 running to the outer circumference 124 of the rotor body 106.

In assembled state the release pin 34 rests on the straight line region 120, that is in an eccentric position. When after pulling of the locking pin 69 the spring force of the spiral spring 15 is larger than the force exerted by the release pin 34 on the seat surface 110, then the rotor 1 rotates clockwise and presses the release pin 34 out, which pin is supported in the ring 27 and in the locking piece 3. At the same time, the front end of the release pin 34 slides from the straight line region 120 via the bevel 121 to the outer circumference 124 of the rotor body 106 and has thereafter no possibility to induce a rotating motion of the rotor 1.

If in contrast, the force exerted by the release pin 34 on the seat surface 110 is larger than the spring force of the spiral spring 15, then the rotor rotates in counterclockwise direction and the eccentrically disposed release pin 34 slides with its front end along on the seat surface 110. Since the release pin 34 has a finite width, the arc shaped recess 122 prevents a wedging of the rotor 1 and the release pin 34, since the cross-section of the release pin prevents it. In this way the release pin 34 can rotate the rotor 1 by an angle of 90° into the ignition position.

The rotor shaft 107 follows the rotor body 106. The rotor shaft 107 is provided with a radially passing through bore hole, which receives the detonator 115, which is provided with a bush 116. The guide groove 101 can be recognized near the lower bearing pin 118. The guide groove 101 comprises essentially three regions, that is an external ring 102 as a dummy setting groove, an internal ring 104 as a live setting groove, and an axial recess 103, which connects the external ring 102 and the internal ring 104 with each other, which extend starting with the axial recess 103 in circumferential direction in opposite directions and thus form two paths of arcs of a circle. The outer ring 102 is in this situation limited by the two stops 108 and 109, while the inner ring 104 extends over a longer arc of a circle and is provided by a stop 105.

As is shown in the plan view of the rotor 1 according to FIG. 9, the guide pin 201 engaging the guide groove 101 can only then move in axial direction, when it is located close to the stop 108 and when it is aligned with the axial recess 103. If it is too much in the proximity of the other stop 109 in the external groove 102, then it cannot move in axial direction, since it then strikes against the axial stop 125. Thus when the rotor 1 is clockwise rotated by the force of the spiral spring 1, then the guide pin 201 at the piston 2 strikes against the stop 109 and thereby is disposed also in front of the axial stop 125 such that a later actuation of the first water pressure safety device 44 cannot move the guide pin 201 in axial direction.

Operation

The above described ignition device operates as follows. Before passing the ignition device into water the safety pin 63 with the warning flag 63*a* is removed from the locking pin 69 and is preserved by the operators for control purposes in order to get an overview about the ignition devices and explosive charges placed. The ignition device is then lowered into water and brought with a suitable vehicle to the place of application. At this point in time the individual groups of devices of the ignition device are in the rest position shown in FIGS. 1 and 3 to 5, wherein the guide pin 201 is located in the external ring 102 and contacts the stop 108 such as to be aligned with the axial recess 103.

With increasing water depth the first membrane 19 pretensioned by the conical spring 18 is impacted in increasing degree by water entering from the sieve 47 and through the passages 45 and pressing into the interior of the housing 10. At the same time the piston 2 and the guide pin 201 attached thereto are moved forward in the axial recess 103 until it contacts against the inner side wall of the internal ring 104. While the guide pin 201 in its rest position contacts the stop 108 and thus blocks a counterclock rotation of the rotor 1 into the ignition position, the guide pin 201 now in the internal ring does not resist against a rotation of the rotor in counterclockwise direction, such that the same can be rotated upon overcoming of the spring force of the spiral spring 15 into the live setting or the ignition position.

As soon as the predetermined water depth has been reached, the first water pressure safety device is actuated and the guide pin 201 is moved into the internal ring 104 as live setting groove, upon reaching of the operating water depth of the second water pressure safety device, the locking pin 69 can be pulled out with the tow cable 65, without having the pretensioned rotor 1 push out the release pin 34, since now the guide pin 201 contacts in the axial recess 103 against the stop 105 and prevents a corresponding rotation of the rotor 1 in clockwise direction.

With pulled out locking pin 69 the bore holes 68 form water entrance openings for impacting the second membrane 37 of the second water pressure ignition device 54; holes 68 prevent a sudden load on the membrane in order to avoid damage and deformations. The release pin 34 is thereby pressed by the water pressure on the membrane towards the inside and rotates the rotor 1 by an angle of 90°, whereby the release pin 34 slides along the seat surface 110 with the arc shaped recess 122 without there being a danger of a wedging. When the rotor 1 has rotated by 90°, then the detonator 115 is opposite to the contact pin 25, which contacts the detonator 115 via its pressure spring 26.

Simultaneously with the pressing in of the release pin 34, the advance of the plate 28 mounted on the piston 36 occurs until the plate bridges the contact pins 31. The contact pins 31 are disposed in the contact pin casing 8, which in turn is mounted with attachment pins 85 and 86. The contact pins 31 are pressed by springs 32, which on the one hand provide for a safe contact with the plate 28 and which are on the other hand connected to a contact plate 35, which in turn is electrically connected with the pins 85 in order to close at this place the switching circuit.

A pulling of the locking pin 69 in air or at low water depth results in moving the rotor 1 with its detonator 115 into an irreversible blind position, wherein the release pin 34 engages the seat surface 110 of the rotor 1, while the guide pin 201 of the piston 2 of the first water pressure safety device 44 moves into its dummy setting groove.

As the above explanations show, the rotor 1 represents an integral part of the novel ignition device, and wherein the form of the guide groove 101 is an important consideration. If the guide groove 101 is unwound into a plane, then this guide groove can be visualized as a stylized S, wherein the upper and lower bars (internal ring 104 and external ring 102) adjoin in each case with a right angle to the vertical bar (axial recess 103).

In the rest position of the ignition device the guide pin 201 is located at the outer end of the axial recess 103 and thus simultaneously in the external ring 102, wherein it contacts against the stop 108. The guide pin 201 performs a double function in this rest position: On the one hand it prevents a rotation of the rotor 1 in counterclockwise direction into the live position of the ignition device, since such rotation would be premature, since the preselected water pressure had not yet built up, which actuates the first water pressure safety device 44. On the other hand, the guide pin 201 is prepared in this rest position for sliding into the live setting, in case the required water pressure is applied to the first water pressure safety device.

If the first water pressure safety device is properly actuated, then the guide pin 201 has moved along the axial recess 103 into the internal ring 104 as a live setting groove and the guide pin contacts against the step 105 and prevents a rotation of the rotor in clockwise direction, by which the release pin 34 would be pushed out after pulling out of the locking pin 69, since after pulling of the locking pin 69 first a pressure has to be built up via the second membrane 37 of the second water pressure safety device 54, before the release pin 34 can rotate the rotor 1 into the ignition position against the force of the spiral spring 15.

In case that a too early actuation of the locking pin 69 has occurred and the rotor has turned in clockwise direction, then a relative motion between the guide pin 201 and the rotor has occurred, which contacts the guide pin 201 in the external ring 201 against the radial stop 109. Also in this position there results a double function, since on the one hand the stop 109 prevents a further rotation of the rotor 1 and since on the other hand the axial stop 125 opposite to the guide pin 201 limits the axial motion of the guide pin 201 and prevents that the guide pin 201 can still reach the internal ring as a live setting groove, since the rotor is correspondingly pretensioned with its spiral spring 15.

As already mentioned, an ignition of the ignition device does also then not necessarily occur, when the rotor has moved into the live setting, since the ignition itself depends on the reception of a suitable ignition pulse at the receiver part of the electronic plug-in module 59. In case a received ignition pulse is not compatible with the ignition electronics, or when no ignition pulse is received, the ignition is absent in these cases. After a certain time of readiness the ignition electronics destroys itself and assures thus that after this time a functioning of the ignition device is not possible.

It should be pointed out that the above described ignition device is also insensitive to other arbitrary manipulations. The first water pressure safety device is located far into the interior of the housing 10. Its water feed-throughs 45 are connected via an inclined falling channel, allowing a flowing off of the water, connected to the sieve 47 at the front side of the ignition device (compare FIG. 2). The second water pressure safety device 54 is located at an inaccessible place in the interior of the housing 10 and can at all only via the release pin 34 and through the bore holes 68 and **68*a* be impacted with water entering through a small cross-section. In case a manipulation is attempted at this place, this requires a pulling out of the locking pin 69, which however in the way described results in rotating the rotor 1 into its dummy position, thereby rendering impossible an ignition of the ignition device, since the rotor is correspondingly pretensioned with its spiral spring 15**. Thus the above described ignition device represents an extremely safe arrangement, which meets even highest requirements.

Operation of the Electronic Plug-in Module

The following description illustrates the operation of the circuitry disposed in the electronic plug-in module 59 of the underwater ignition device.

This circuit provision comprises an analog receiver part, a digital logic part, as well as two via driver stages connected parallel discharge circuits, in order selectively either to ignite the detonator or to separate the circuitry from its voltage supply and to short out the latter, wherein the digital logic part controls the actuation of the two discharge circuits in successive time intervals depending on two frequency and time correlated input signals.

Thus it is advantageously achieved that no ignition is possible during a first time interval, in order to avoid accidents, and that within a second time interval at arbitrary points in time an ignition is possible, but not required, in order to match the momentary situation in each case, and in a third time interval the voltage supply is permanently switched off in order to avoid accidents and to exclude safely ignitions by chance.

Advantageously, the selective band-pass behavior of the analog receiver part is exploited thereby, which is only constructed for a small frequency region of the possible input signal, resulting in a clear screening of the digital circuit against spurious and foreign signals. In addition, the circuitry of the present invention provides the advantage of high operational safety by employing C-MOS devices, which require in operation small currents, and by employing a lithium battery as an energy source capable of being stored for a number of years. C-MOS is an abbreviation for "complementary metal oxide semiconductor device". Such a device is formed by the combination of a p-channel metal oxide semiconductor device with an n-type channel metal oxide semiconductor device. It is preferably formed compatibly on silicon chips and connected into push-pull complementary digital circuits offering low quiescent power dissipation. A lithium battery employs lithium as an anode and a nonaqueous solvent as an electrolyte. As a cathode material, for example, $SO_2$ can be employed and the elctrolyte can be acetonitrile and LiBr.

It will be easily recognized that the ignition circuit of the present invention can be employed for a variety of mine destruction charges as well as for other underwater apparatus. In addition, there exist, of course, other possibilities of application, for example when the switch employed in the embodiment in the water pressure safety device is substituted by another switch, the closure of which puts into operation the ignition circuit. While employing of the ignition circuit in accordance with the present invention in combination with a mechanical arrangement of locking pin and water pressure safety devices represents a suitable mode of application, the circuitry of the present invention is under no circumstances limited thereto.

General Function

The complete ignition circuit of the ignition electronics is activated by connecting the ignition circuit via switch 242 of the water pressure safety device with the internal battery 40 upon reaching a predetermined water depth of a few meters. The battery is preferably a lithium battery. At a battery voltage $U_{batt}$ under normal conditions a normal load current flows, whereas during the moment of switching-on for about one second an increased about double load current flows. This behavior is at the same time the control for the function of the control signal generator 226, which takes care that at the begin of the mission the digital time base 222 and the other digital device groups 224 to 232 are placed into a defined starting position. In addition to other safety measures, during the first operating second the gate electrode of the ignition thyristor Thyl is short-circuited and thus an ignition of this ignition thyristor Thyl is safely prevented.

Figure 10:
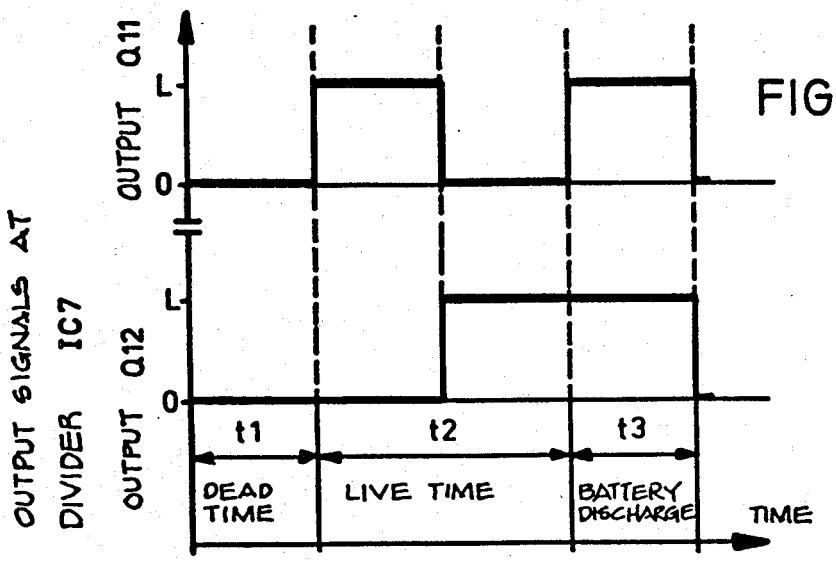
FIG. 10 is a pulse diagram of output signals at two outputs of a divider for illustrating the sequence of dead time, live time and battery discharge time in the ignition device of the present invention.

The digital time basis 222 begins with the generation of a time tact at the end of the control signal. The pulse diagram is shown in FIG. 10 wherein the logic output levels of the two outputs employed Q11 and Q12 of the divider are plotted versus the time. Thus the total mission time comprises three main intervals, that is: the dead time $t_1$, the following live time $t_2$ and finally the battery discharge time $t_3$. The generation and application of the logic signals shown in FIG. 10 is illustrated in the following.

During the dead time in the time interval $t_1$ a sound signal received by the hydrophone 210 can be amplified and passed through by the Schmitt-triggers, which substantially comprise transistors T3 and T5, and T4 and T6, respectively. However the digital decision and connecting logic prevents the output of an output signal from the power inverter I3 of the integrated circuit IC9 to the ignition thyristor Thyl and an ignition is during this time interval $t_1$ still not possible.

During the live time in the following time interval $t_2$ the input decoder IC4A in connection with the time base decoder IC4B allows the preparation of the NAND gate G1 in IC8 such that upon an incoming correct ignition signal the power inverter I3 of the IC9 is connected through and thereby the ignition process is initiated. When such an ignition signal does not occur during the live time in the time interval $t_2$, then during the following time interval $t_3$ the battery is discharged and via a safety fuse Si the complete evaluation electronics is separated from the power supply. This way an ignition becomes impossible, and a recovery of the corresponding mine destroying charge or of the underwater ignition device is, after the mission, possible but not required.

Figure 11:
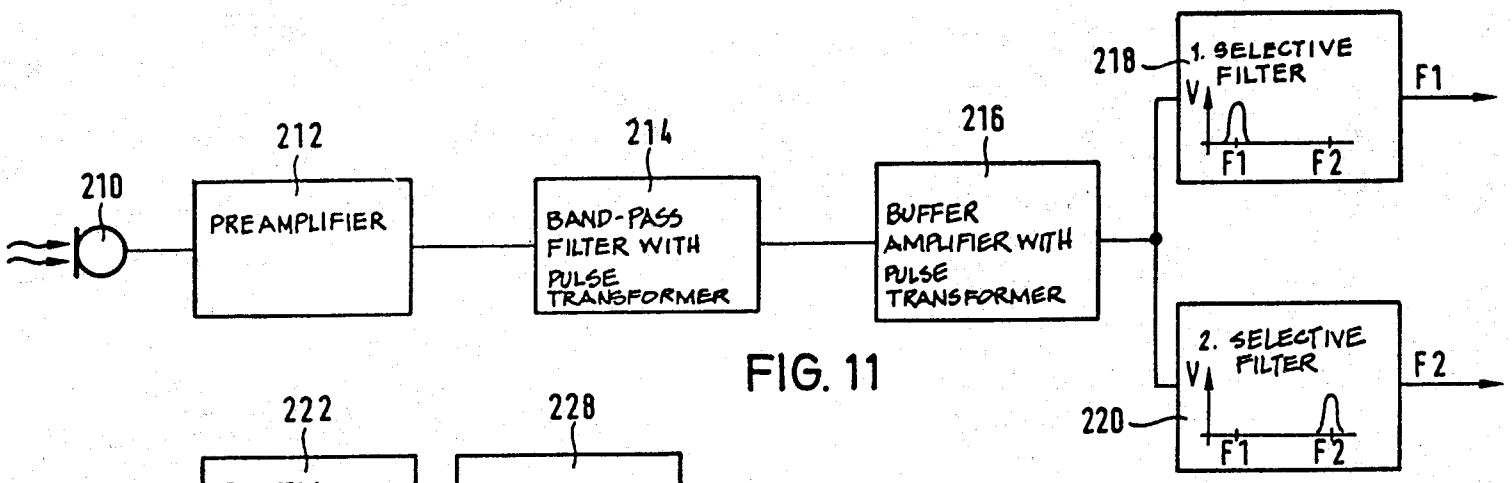
FIG. 11 is a block diagram for illustrating the signal flow in the ignition circuit of the invention referring in particular to the receiver part.
Figure 16:
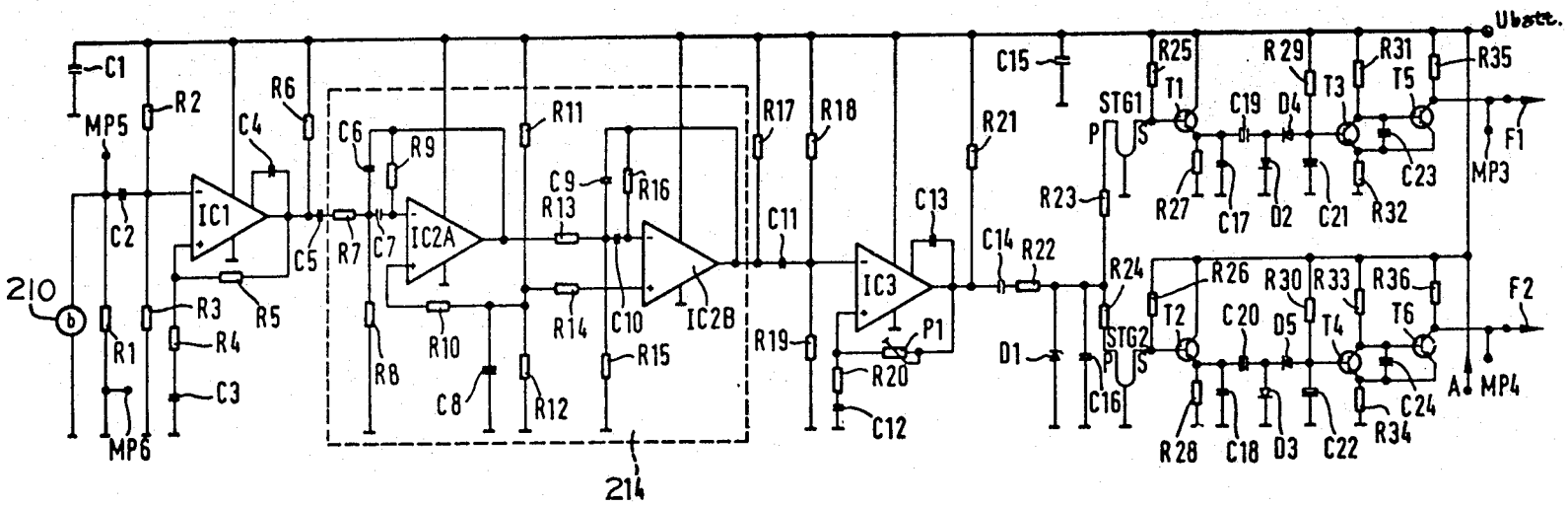
FIG. 16 is a view of a circuit diagram for illustrating details of the circuitry according to the present invention referring in particular to the building blocks of FIG. 11.

ANALOG PART WITH PREAMPLIFIER, BAND-PASS FILTER AND BUFFER AMPLIFIER (COMPARE FIGS. 11 AND 16)

The analog part of the ignition circuit according to the present invention comprises substantially a preamplifier 212, a band-pass filter 214, a buffer amplifier 216, as well as a first and a second selective filter 218 and 220, respectively, is schematically shown in FIG. 11, and is shown in detail in FIG. 16.

Preamplifier

A subaqueous microphone, an electroacoustic transducer, or a hydrophone 210 is employed for the reception of the coded sound frequency signals emitted by a sound emitter. The ceramic pressure transducer or hydrophone 210 is connected immediately at the input of the circuit (compare FIG. 16) to a resistor R1 in order to linearize the transfer constant and in order to avoid the formation of a static D.C. voltage based on the self-capacity of the hydrophone 210.

The acoustic signal received by the electroacoustic transducer or hydrophone 210 is then fed via the coupling capacitor C2 to the inverted input of the analog operational amplifier IC1, which represents the essential part of the preamplifier 212. The inverted input of the operational amplifier IC1 is situated symmetrical with two high impedance resistors R3 and R2 between ground and supply voltage $U_{batt}$, whereas the supply line itself is separated from ground by two capacitors C1 and C15. Two measurement points MP5 and MP6 for the sound signal received are located at the two ends of the resistor $R_1$. The non-inverted input of the operational amplifier IC1 is connected via a resistor R4 and a capacitor C3 to ground.

The amplification of this first amplifier stage is $V_1 = 1000$ Â 60 dB, corresponding to the selected frequency dependent negative feedback of the operational amplifier IC1 via the resistor R5 and the series connection of the resistor R4 and the capacitor C3. The value of the output voltage of the electroacoustic transducer or hydrophone 210 is U1 for a received sound signal such that at the output of the preamplifier 212 a correspondingly amplified signal is present with a value U2 for further processing.

The RC-section comprising the resistor R4 and the capacitor C3 provides for a frequency dependent amplification of the starting signal and the damping is about 6 dB per octave. In connection with the RC-section comprising the capacitor C2 and the resistor R3 and with the resistor R1, respectively, which form together a high pass, there results already at this point a slight band-pass behavior. The capacitor C4 serves to frequency compensate the operational amplifier IC1. The output of IC1 is connected to the supply voltage via a resistor R6 and to the inverted input of a first operational amplifier IC2A of the following band-pass filter 214 via a capacitor C5, a resistor R7 and a capacitor C7.

Band-pass Filter

The band-pass filter 214 comprises substantially two operational amplifiers IC2A and IC2B with corresponding circuitry in order to realize the already in the preamplifier 212 aimed at band-pass behavior with a more pronounced damping curve.

The output of the operational amplifier IC2A is connected to the inverted input via a resistor R9 and is connected via a capacitor C6 to the input of the capacitor C7 as well as to the one side of the resistor R8, which on its other side is connected to ground. The non-inverted input of the operational amplifier IC2A is connected to one side of the resistor R10, which is on its other side connected via a capacitor C8 to ground, via a resistor R12 again to ground, via a resistor R14 to the non-inverted input of the next operational amplifier IC2B and via a resistor R11 to the supply voltage. The output of the operational amplifier IC2A is connected via a resistor R13 and a capacitor C10 to the inverted input of the second operational amplifier IC2B of the band-pass filter 214. The output of the operational amplifier IC2B is connected via a resistor R16 with its inverted input as well as via a capacitor C9 to the input of capacitor C10 and to the one side of the resistor R15, which is connected to ground on its other side.

Figure 13:
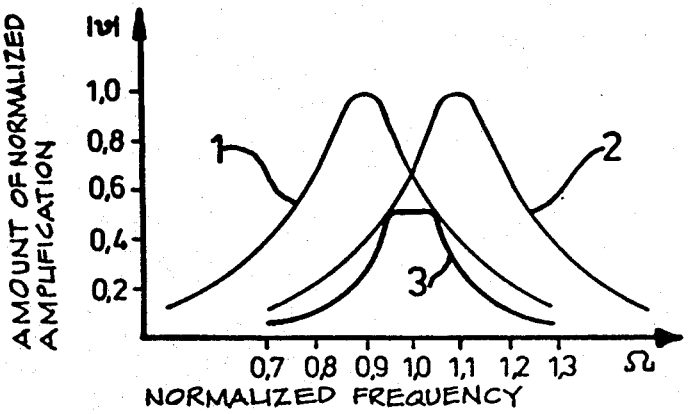
FIG. 13 is a band-pass filter characteristic of the filters employed in the band-pass filter of the ignition circuit.

The desired band-pass behavior with a pronounced damping curve, for example, can be achieved by connecting in series two selective filters of the first order, which have their resonance frequencies slightly out of tune, which also can be called staggered tuning. The qualitative damping curve is shown in FIG. 13, wherein the amount of the normalized amplification is plotted versus the normalized frequency. There the curves 1 and 2 show the frequency dependence of the individual filters whereas the thick line curve 3 shows the resulting frequency dependence.

It can be recognized that the resulting frequency dependence shown in curve 3 is substantially more flat near the resonance frequency, as the frequency dependence of the individual low pass filters, however, is more steep at higher and lower frequencies. An optimized band-pass filter for the transfer range as employed in the complete circuit arrangement is shown in detail in FIG. 14.

Figure 14:
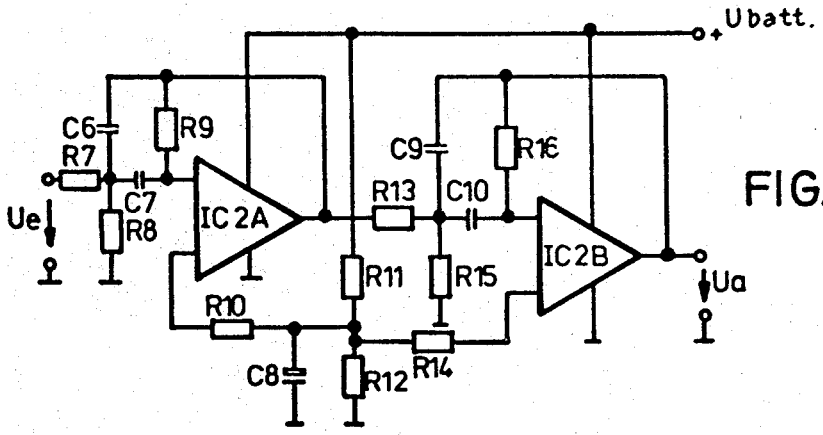
FIG. 14 is a view of a circuit diagram of the selective band-pass filter employed.
Figure 15:
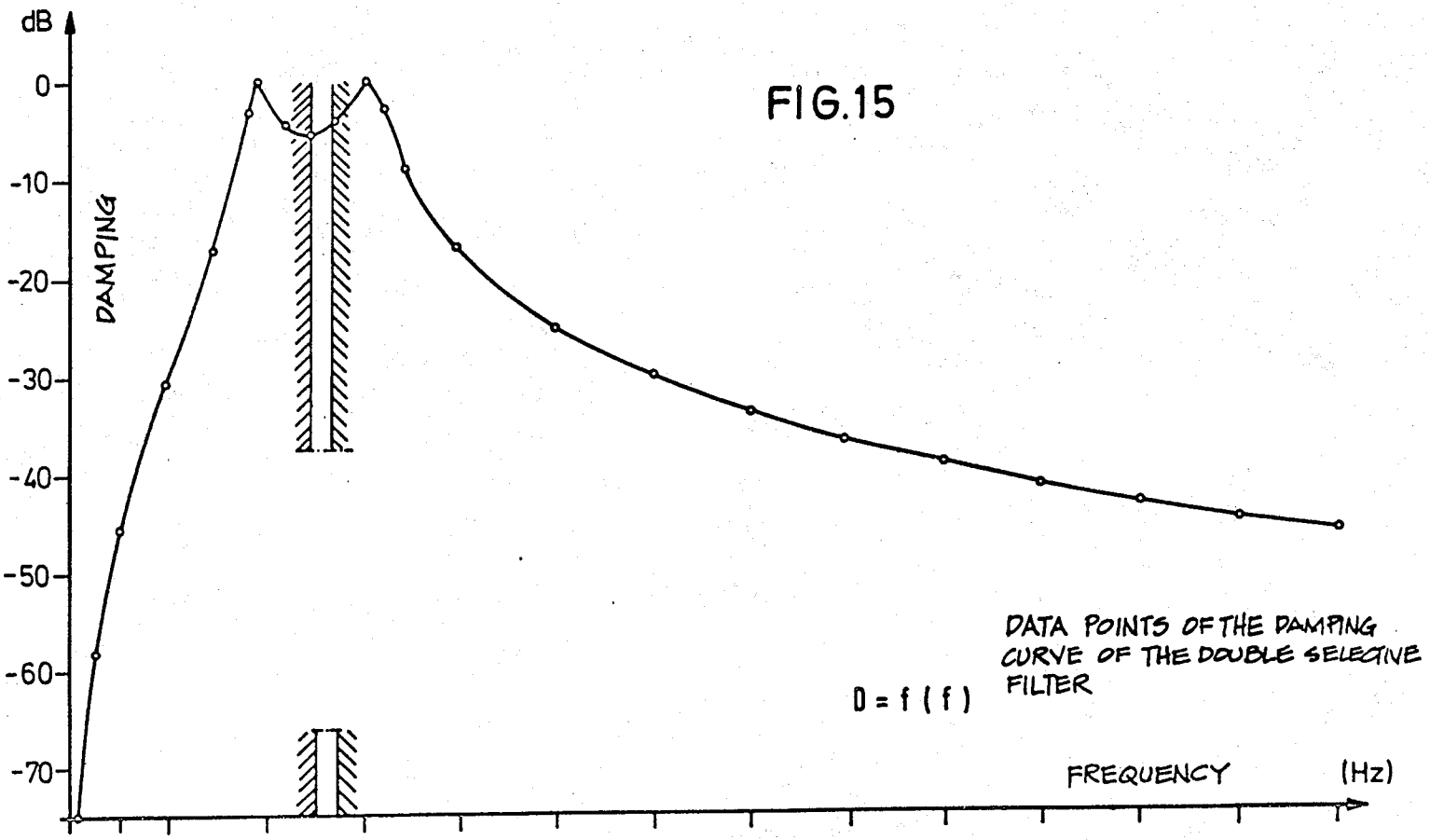
FIG. 15 is a graphical representation for illustrating the damping curve of the selective band-pass filter according to FIG. 14.

The selective band-pass filter according to FIGS. 14 and 16, respectively, has the damping curve shown in FIG. 15.

By employing devices with a maximum tolerance of 1 percent for the resistors R7 to R13 and of 2.5 percent for the capacitors C6 to C10, respectively a sufficiently small frequency change results for the temperature region of from −20° C. to +50° C.

The saddle of the transfer constant at the band ends shown in FIG. 15 amounts to at most 6 dB and is practically unimportant, since in fact in the range used in the applications the amplification is constant to about ±1 dB.

Buffer Amplifier

The signal amplified in the preamplifier 212 and prepared and amplified in the band-pass filter is entered at the inverted input of the operational amplifier IC3 via the coupling capacitor C11. The input side of the capacitor C11 is connected to the supply voltage via a resistor R17, whereas the inverted input of the IC3 is symmetrical between ground and supply voltage with two high impedance resistors R18 and R19. The non-inverted input of the operational amplifier IC3 is connected to ground via a resistor R20 and a capacitor C12, such that the operational amplifier is weakly frequency dependent, negatively coupled via the RC-section R20/C12. The output of the operational amplifier IC3 is connected to its non-inverted input via a potentiometer P1 for adjusting the required output voltage for controlling the Schmitt-trigger and the two selective filters 218 and 220. A measure for the maintenance of the selected sensitivity is the well-defined switching of the Schmitt-trigger, which can be shown for the two frequencies F1 and F2 at the two test points MP3 and MP4 at the output of the two selective filters. The capacitor C13 serves for frequency compensation of the operational amplifier IC3. Furthermore, the output of the operational amplifier IC3 is connected via a resistor R21 to the supply voltage.

All four operational amplifiers IC1, IC2A, IC2B and IC3 are in the usual way connected to the supply voltage and to ground (compare FIG. 16).

The now low-impedance and low frequency output signal at the output of the buffer amplifier 216, that is, at the output of the operational amplifier IC3, is decoupled via a decoupling capacitor C14 and passes via an RC-low pass section comprising a resistor R22 and a capacitor C16 to the zener diode D1 employed as a limiter, which zener diode limits the low frequency output signal upon reaching of the zener voltage.

This measure assures that upon constant amplification with a stronger input signal, for example, in a case of small ignition and explosive distance, the following tuning fork filters are not overloaded by the Schmitt-triggers. The result would be that the allowed switching band width of the tuning fork filter would deviate too much from the nominal frequency. In this way part of the achieved high selectivity would again be lost.

Selective Filter and Schmitt-trigger

The low frequency voltage available at the output of the buffer amplifier 216 is fed via the two decoupling resistors R23 and R24 to the two selective filter channels for the coded frequencies F1 and F2 for further signal preparation, where they can be separately further processed. The required high selectivity and transmission performance can be realized with reasonably low circuit expenditure only via piezoelectrical tuning fork filters, which maintain the imprinted nominal resonance frequency exactly to about ±1 hertz.

The two tuning fork filters StG1 and StG2 are in each case connected to a transistor T1 and T2, respectively, in the channel F1 and F2, respectively, which transistors are employed as emitter followers and which each control a Schmitt-trigger via the decoupling capacitors C19 and C20, respectively. The Schmitt-trigger comprises the two transistors T3 and T5, and T4 and T6, respectively. The channel for the signal F1 is located at the base of the transistor T1, which is connected to the supply voltage via resistor R25, the emitter of the transistor T1 is connected via a resistor R27 and a parallel capacitor C17 to ground and the collector of the transistor T1 is connected directly to the supply voltage. The capacitor C19, connected at its input side to the emitter of the transistor T1, is connected at its output side via a diode D2 positioned in non-conducting direction to ground and provides the output signal of the transistor T1 via the diode D4 positioned in conducting direction to the base of the transistor T3 of the first Schmitt-trigger. The base of the transistor T3 is connected via a resistor R29 to the supply voltage and via a capacitor C21 to ground.

The collector of the transistor T3 is connected via a resistor R31 to the supply voltage, via a capacitor C23 to its own emitter and directly to the base of the following transistor T5. The emitter of the transistor T3 is connected via a resistor R32 to ground and is connected to the emitter of the following tansistor T5. The emitter of the transistor T5 is connected to its base via the capacitor C23 and the collector of the transistor T5 is connected to the supply voltage via a resistor R35. In addition the test point MP3 is located at the collector of the transistor T5.

In the second Schmitt-trigger, the base of the transistor T2 employed as an emitter follower is connected to the second tuning fork filter StG2 and is connected via a resistor R26 to the supply voltage and the collector of the transistor T2 is connected directly to the supply voltage. The emitter of the transistor T2 is connected to ground via a parallel circuit of resistor R28 and capacitor C18 and the output signal of the transistor T2 is connected via the emitter, the coupling capacitor C20 and a diode D5 positioned in conducting direction to the base of the transistor T4 of the second Schmitt-trigger. The output side of the capacitor C20 is connected to ground via a diode D3 positioned in non-conducting direction. The base of the transistor T4 is connected via a resistor R30 to the supply voltage $U_{batt}$ and via a capacitor C22 to ground. The collector of the transistor T4 is connected via a resistor R33 to the supply voltage and directly to the base of the transistor T6 of the second Schmitt-trigger. A capacitor C24 is disposed between the collector and the emitter of the transistor T4, while the emitter of the transistor T4 is connected via a resistor R34 to ground and is connected directly to the emitter of the transistor T6. The collector of the transistor T6 is connected via a resistor R36 to the supply voltage and furthermore the collector of the transistor T6 provides the test point MP4 for the signal F2 with the second code frequency.

Both Schmitt-triggers work with switching delays in the millisecond region, such that interference pulses and noise signals do not result in an erroneous release. Thus the measure of introducing a switching delay serves the purpose of operational safety. After the connecting through of the two Schmitt-triggers with the transistors T3 and T5, and T4 and T6, respectively, there is at the two test points MP3 and MP4 in each case a DC-signal with a level of about 0 $V_{=}$, which serve as input signals for the digital logic and connecting part of the ignition circuit.

The adjustment of the buffer amplifier 216 for the following selective filters is performed in the way that at the test point MP5 an input signal is introduced, wherein the two frequencies F1 and F2 are selected in accordance with the characterized coding of the ignition device.

Then at the test point MP3 the switching of the Schmitt-trigger with the transistors T3 and T5 is supervised for the frequency F1, while the amplification is set at the potentiometer P1. An initially introduced DC-signal with a level of $U_{batt}$ is transformed by the switching of the Schmitt-trigger to a level of about 0 $V_{=}$. In the same way at the test point MP5 the input signal with the frequency F2 is introduced and the switching of the second Schmitt-trigger with the transistors T4 and T6 is checked at MP4. Thereby the adjustment of the amplification is completed and the total amplification of the amplifier-filter chain equals the sum of the amplifications of the individual amplifiers.

Digital Part of the Ignition Circuit

Figure 17:
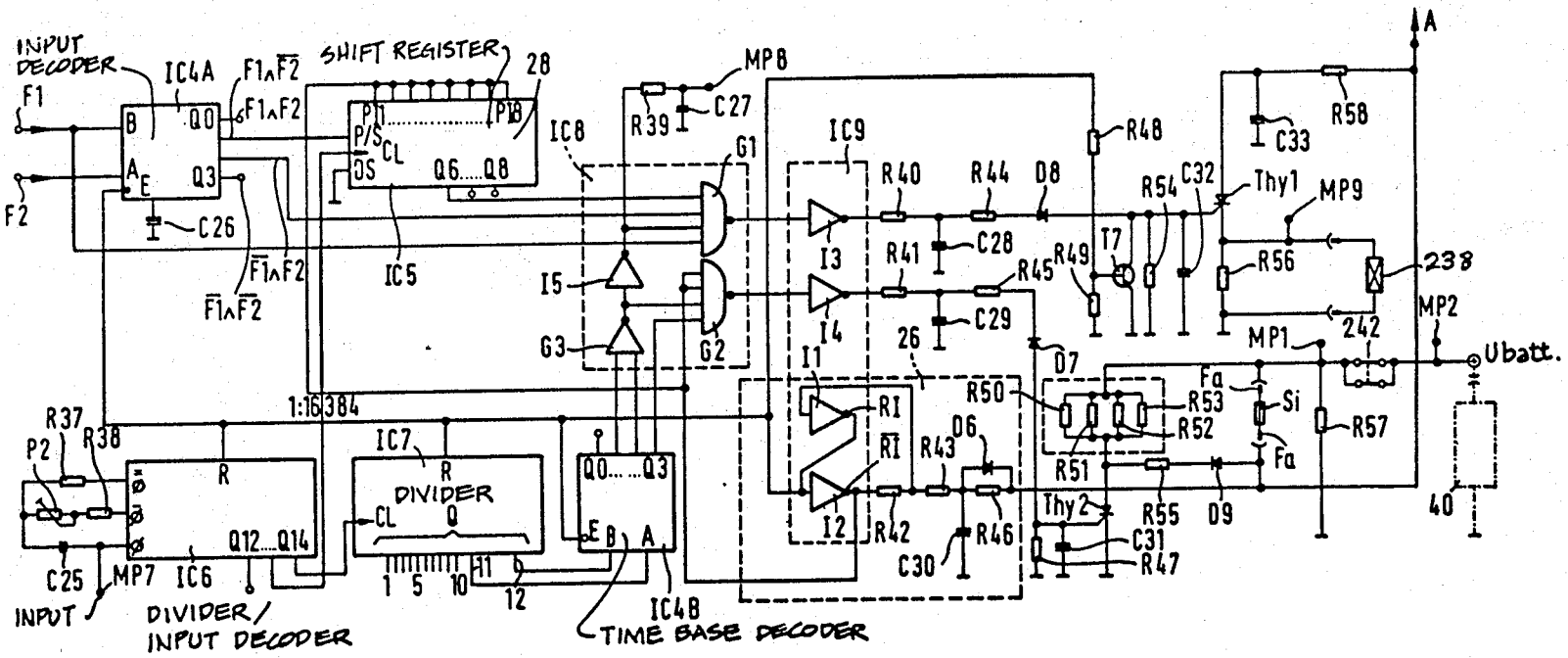
FIG. 17 is a view of a circuit diagram for illustrating details of the circuitry according to the present invention referring in particular to the blocks shown in FIG. 12.

All integrated circuits IC4A, IC4B, IC5, IC6, IC7, IC8 and IC9 in the digital part of the ignition circuit are produced by C-MOS technique and are connected to the supply voltage $U_{batt}$ and to ground, respectively, in conventional manner, and these connections have been deleted in the drawing for purposes of improved clarity. As shown in FIG. 17, the two signals F1 and F2 after their amplification and filtering in the analog part are entered into the two inputs A and B into the input decoder IC4A, while the signal F1 in addition is fed to the fourth input of the NAND gate G1. The supply voltage of the input decoder IC4A is blocked from ground through a capacitor C26. The outputs Q0 and Q3 of the input decoder IC4A are running out free, while the output Q1 of the input decoder IC4A is connected to the P/S control input of the shift register IC5 and the output Q2 of the input decoder IC4A is connected to the second input of the NAND gate G1.

The input of the inverter I2, via a resistor R48 the base of the transistor T7, the clock input E of the time base decoder IC4A, the restoring input of the divider IC7, the restoring input R of the divider IC6 and the clock input E of the input decoder IC6 are connected to the output RI of the inverter I1. The output Q12 of the divider IC6 is led outside, the output Q13 of the divider IC6 is connected to the clock input CL of the shift register IC5 and the output Q14 of the divider IC6 is connected to the clock input CL of the divider IC7. The outputs Q11 and Q12 of the divider IC7 are connected to the inputs A and B respectively, of the time base decoder IC4B.

At the time base decoder IC4B the output Q0 is led outside, the two outputs Q1 and Q2 are connected to the two inputs of the of the NOR-gate G3 and the output Q3 is connected to the fourth input of the NAND gate G2. The output of the NOR gate G3 is connected to the third input of the NAND gate G2 and to the input of the inverter I5. The output of the inverter I5 is on the one hand connected to the third input of the NAND gate G1 and on the other hand connected via the resistor R39 to the test point MP8, which is blocked against ground via a capacitor C27. The output RI of the inverter I2 is connected to the first two inputs of the NAND gate G2 and to the eight parallel data inputs PI1 to PI8 of the shift register IC5. The input DS of the shift register IC5 is connected to ground, its two outputs Q7 and Q8 are led outside and the output Q6 is connected to the first input of the NAND-gate G1. The outputs of the two NAND gates G1 and G2 are connected to the inverters I3 and I4, respectively, which provide via resistors R40 and R41, respectively, the signals for the detonator circuit and the battery discharge circuit, respectively. The output of the inverter I2 is led back to the input of the inverter I1 via a resistor R42.

The divider IC6 is switched in the way indicated such that the input $\emptyset$ is connected to the input $\overline{\overline{\emptyset}}$ via a capacitor C25 and a resistor R37 and is connected to the input $\overline{\emptyset}$ via a series connection comprising a potentiometer P2 and a resistor R38. The input $\emptyset$ itself is at the test point MP7, which can be employed as a time compression input.

Input and Output Functions of the Digital Part

Two input functions are formed by the two signals F1 and F2, which are trapezoidal pulses which run from "L" to "$\emptyset$" and which have a rise time of about 50 milliseconds, a turn-on delay of about 50 milliseconds and a decay time of about 50 milliseconds. The pulse duration is for regular emission and undisturbed reception about 1 second, however the emitted pulse can be varying or chopped up resulting from interference during the transmission path. Despite the above indicated intentionally flat provided edge steepness, the pulses are nevertheless suitable for processing in the following C-MOS circuits. There is a certain pulse pause between the two signals F1 and F2.

The supply voltage or the battery voltage $U_{batt}$ represent an additional input function since from its rise upon switching on of the battery 40 through the switch 242 of the water pressure safety device is derived the control signal RI, which puts all flip-flops within the C-MOS switching circuits into their initial position and which furthermore during the transient time blocks the ignition release with a safety circuit.

The two output functions of the digital part are the ignition current for the detonator 238 and the battery discharge current of the battery 40.

As mentioned above, the digital part of the ignition circuit performs several functions. On the one hand, the digital part controls if the signals F1 and F2 appear with about the right pulse duration and in the preset time sequence. In addition, the detonator circuit is blocked, if this condition is not met. Furthermore, the input functions are logically connected with each other and the two signals for igniting the ignition thyristor Thyl for the detonator and the discharge thyristor Thy 2 for the battery, respectively, form and block, respectively, these signals depending on the time function. In addition all memories are set upon switching on of the battery and the output functions are blocked. For the performance of these different tasks the following time functions are formed:

(a) Live time: Release of the ignition of the detonator 238 after $t_1$ after the closing of the switch 242 of the water pressure safety device in a predetermined depth of several meters of water;

(b) Termination of live time: Blocking of the release of the ignition of the detonator 238 after $t_1+t_2$ after the closing of the switch 242 of the water pressure safety device and separating of the complete ignition circuit from the battery;

(c) Discharge of the battery 40 also after time $t_1+t_2$ after the closing of the switch 242 of the water pressure safety device;

(d) Time window with 3 seconds: Release of the signal for ignition of the detonator 238 for about 3 seconds, after the signal F1 has again disappeared, such that the level increases again to the voltage of $U_{batt}$. The signal F2 has to fall into this time window to fulfil the ignition condition of the detonator 238.

The individual groups of devices of the ignition circuit are illustrated in the following in detail.

Input Decoder

The input decoder IC4A serves to scan the two signals F1 and F2, which are generated in the two selective filters 218 and 220 by the two Schmitt-triggers. In the following description the following designations are employed for the signals:

F1, F2: logic "L" (DC-signal with 11.2 $V_=$)

$\overline{F1}$, $\overline{F2}$: logic "$\emptyset$" (Zero signal).

The two signals $\overline{F1}$ and $\overline{F2}$ are provided at the test points MP3 and MP4 by the outputs of the two Schmitt-triggers, at which outputs is located the interface between the analog and digital part of the ignition circuit. The two signals are fed to an input decoder IC4A constructed in C-MOS technique and the input code is to be conceived as a two bit binary code, that is the logic signals $\overline{F1}$ and $\overline{F2}$ are deemed to be binary variables and can appear in arbitrary distributions. The output code of the input decoder IC4A is a lout of 4-code, wherein in each case one of the four outputs can conduct a "L"-signal. The additional clock input E is controlled only with the control signal RI from the inverter I1 and blocks all four outputs of the input decoder IC4A during the transient switching on of the battery 40.

As is shown in FIG. 17, only the two outputs Q1 and Q2 are employed, wherein Q1 is active and conducts an "L"-signal when $\overline{F1}$ is on zero level, that is when F1 has been emitted by the emitter and the analog part as a receiver has properly received the undulation section, selected and amplified the same.

Based on the above indicated truth table (Table 1) of the input decoder IC4A there exists an additional condition, that simultaneously with $\overline{F1}$ also $\overline{F2}$ cannot be present. Vice versa, it holds for the next phase of the signal transmission, that the signal $\overline{F1}$ has to have disappeared before the signal $\overline{F2}$ arrives. In this case the output Q2 of the input decoder IC4A becomes active, while all other outputs provide a $\emptyset$-signal. Upon proper reception of the signals F1 and F2 with the corresponding frequencies, initially a "L"-signal appears at the output Q1 with the information "F1 and $\overline{F2}$", then the "L"-signal changes to the output Q2 and means then "$\overline{F1}$ and F2". If the two signals F1 and F2 are both missing with the corresponding frequencies, or there appear both signals at the same time, then the two outputs Q1 and Q2 are both at Ø-level.

Control Signal Generator

The two in series connected inverters I1 and I2 form as C-MOS buffer inverter in the IC9 with positive feedback via the resistor R42 together with a dropping resistor R43 a Schmitt-trigger in the control signal generator (compare FIG. 17). This Schmitt-trigger controls the charging voltage of the capacitor C30, which is preferably constructed as a tantalum-electrolyte capacitor. Upon switching on of the ignition circuit via the switch 242 of the water pressure safety device the capacitor C30 is charged via the charging resistor R46 to the supply voltage $U_{batt}$. The time constant of the charging process is about ½ second.

The following Schmitt-trigger flips about one second after switching on. The output $\overline{RI}$ remains during this time at Ø-level and jumps then to L-level ($\overline{RI}$-signal). The complementary output RI immediately upon switching on goes to L-level and flips about one second later back to the Ø-level. Both signals are employed in the digital part of the ignition circuit as follows:

The signal RI brings all flip-flops of the binary circuit into the zero position and blocks the input-decoder IC4A and the time base decoder IC4B via the clock inputs E during the control time. In addition, the signal RI provides the control signal for the base of the transistor T7 for the functioning of a short-circuit providing that the ignition thyristor Thy1 remains blocked for the time of the generation of the control signal.

The signal $\overline{RI}$ maintains the parallel data inputs PI1 to PI8 of the shift register IC5 serving to generate the three seconds long time window for about 1 second at the Ø-level. At the same time, the signal $\overline{RI}$ blocks for one second the NAND gate G2 such that no ignition of the discharge thyristor Thy2 is possible.

With the decay of the signal RI and of the thereto complementary signal $\overline{RI}$, the input decoder IC4A and the time base decoder IC4B as well as the NAND gate G2 situated at the output are released for the ignition of the discharge thyristor Thy2. At the same time, the short circuit of the gate electrode as ignition electrode of the ignition thyristor Thy1 for the detonator 238 is interrupted and all binary circuits are released in the dividers IC6 and IC7. The parallel data inputs PI1 to PI8 of the shift register IC5, which operates as a time window 228, are brought to the L-level. The complete ignition circuit is thereby in operation and does not any longer depend on the signals RI and $\overline{RI}$, respectively.

Time Window

The function of the time window 228 is realized with an eight step, static C-MOS shift register IC5, at which the eight parallel data inputs PI1 to PI8 are continuously situated at the L-level. The only series data input, that is the input DS of the IC5, is set fixed at the Ø-level. The three outputs Q6, Q7 and Q8 of the last three flip-flops of the shift register IC5 are led outside; however, only the input Q6 is employed for passing on the time window pulse.

The clock input CL of the shift register IC5 is continuously provided with symmetrical square pulses, which are supplied by the in the following more closely described clock system of the digital time base 222. The pulse sequence frequency is 2.2755 hertz, which corresponds to a period duration of 0.44 seconds. The parallel-series control input P/S determines the function of the shift register IC5.

When at the control input P/S of the IC5 a signal with L-level is present, then the shift register IC5 works in parallel operation, that is it works asynchronously and parallel operation has priority.

When at the control input P/S of the shift register IC5 a signal with Ø-level is present, then the shift register IC5 works in series operation, that is, synchronous with the clock pulses at the clock input CL.

The control input P/S of the shift register IC5 is controlled by the output Q1 of the input decoder IC4A (compare FIG. 17). The shift register IC5 switches to parallel operation in case the output Q1 of the input decoder IC4A switches to L-level, that is, when the signal "F1" and "$\overline{F2}$" is received by the circuit. In this case the output Q6 of the shift register IC5 assumes the L-level and remains for such time on L-level as the signal "F1 and $\overline{F2}$" is present.

When after about one second the signal F1 again disappears, then the output Q1 of the input decoder IC4A switches again to Ø-level such that the shift register IC5 switches again to series operation via the control input P/S. With the next clock pulse at the clock input CL, a logical "Ø" is "shifted" into the first flip-flop of the shift register IC5, since the series data input or control input DS as mentioned above is always positioned at the Ø-level. With the positive slopes of the following clock pulses, the front of signals with Ø-level shifts on from flip-flop to flip-flop. At the next clock pulse the signal reaches the output of the shift register IC5. In this way the pulse designated as "time window" is generated, which has the following duration:

$$T_{ZF} = T_{F1} + a \cdot 0.44 \text{ seconds for } 5 \leqq a \leqq 6$$

$T_{F1}$ is blanked out in the output connection for the ignition of the detonator 238 such that the duration of the time window is from 2.2 to 2.64 seconds. The tolerance width can be explained by the positive slopes of the clock pulses being asynchronous to the signal F1, their phase relationship is purely accidental. The next edge at the transition from the Ø-level to the L-level after the disappearance of the signal F1 can follow immediately or only after 0.44 seconds.

The pulse width of the time window pulse depends besides on this for digital counter circuits usual tolerance only on the accuracy of the oscillator frequency of 2.2755 hertz, to which will be referred in detail in the following in connection with the digital time base 222. The output pulse at the output Q6 of the shift register is connected to the first input of the NAND gate G1 for the output connection of the ignition of the detonator 238.

Digital Time Base

The clock system of the ignition circuit comprises an RC-oscillator with a following 26-bit binary circuit ($2^{26}$=67,108,864) and a decoder, which evaluates the two last bits of the divider chain.

The RC-oscillator is part of a divider IC6 constructed in C-MOS technique with 14 flip-flops connected in series, which form a binary circuit (1:16,384), the operation is asynchronous (ripple carry). The zero position of the divider IC6 is provided via a joint reset input R, and in fact with the above already described control signal RI from the inverter I1. The RC-oscillator integrated with the binary circuit is tuned by the trimming potentiometer P2, where the total resistance through the measuring arrangement at the test point MP7 is about 1 MΩ. The clock input or tact input of the first flip-flop of the divider IC6 is led out and designated as "Ø". By applying an external square pulse sequence to the test point MP7 and thereby to the clock input the oscillator can be overdriven such that the own RC-circuitry becomes ineffective. The following binary circuit processes frequencies up to about 8 Mhz.

For testing the clock program contained in the ignition circuit, for example, an external frequency in the Mhz-region can be fed in via the test point MP7, which shortens the clock time to a few seconds in order to avoid long waiting times during the testing and adjustment, that is, time compression operation is employed at test point MP7. It is important in this context that the square signal to be controlled does under no circumstances have a course symmetrical around zero, but amounts to about 10 $V_{SS}$ beginning at ground level. It has to be observed herein that negative voltages of less than 0.7 V at the test point MP7 can destroy the divider IC6.

The last output Q14 of the 14 step binary circuit in the divider IC6 provides a square frequency of 1.13775 hertz to the following 12 stage binary circuit of the divider IC7 (18641:16384). This divider IC7 divides the square frequency again in the ratio 1:4096, that is by the number $2^{12}$, such that at its last output a square frequency of $2.7777.10^{-4}$ can be tapped off.

From the complete divider chain comprising the dividers IC6 and IC7 the times and frequencies shown in Table 2 are tapped off and evaluated.

The frequency of 2.2755 hertz serves as clock frequency at the clock input C1 for the shift register IC5. The two other frequencies at the two outputs Q11 and Q12 of the divider IC7 are fed to its two inputs A and B for evaluating the time base decoder ICB4. The input code of the time base decoder IC4B is a 2-bit binary code, its output code is a one out of four code. According to the pulse diagram shown in FIG. 10 there are at the output of the time base decoder the three time regions $t_1$, $t_2$ and $t_3$ as can be recognized from Table 3.

During the time $t_1$ after the switching on of the ignition circuit the two NAND gates G1 and G2 at the output of the digital logic part 224 are blocked on the one hand in the two ignition channels for igniting the detonator 238 and on the other hand for the discharge of the battery. The only output of the time base decoder IC4B carrying a signal at L-level, that is Q0, is not used. After the time $t_1$ the signal with L-level changes to the output Q1 of the time base decoder IC4B. This signal with L-level then moves to the output Q2 and finally after the time $t_1+t_2$ after switching on the signal moves to the output Q3 of the time base decoder IC4B, where the outputs Q1, Q2 and Q3 are fed to the output interface of the digital logic part.

Output Connections for Igniting the Detonator and for Charging the Battery, respectively For controlling the ignition thyristor Thy1 releasing the ignition of the detonator 238 a total of four conditions have to be met:

(a) A time interval of $t_1$ has passed after the switching on of the ignition circuit: A signal with L-level is present at the third input of the NAND gate G1 in IC8.

(b) A signal F1 has been received: Thus a signal with L-level is applied at the first input of the NAND gate G1 of the IC8 for the duration of the signal F1 and an interval of about 2.4 seconds.

(c) The signal F1 has again disappeared: A signal with L-level is applied to the fourth input of the NAND gate G1 of the IC8.

(d) Immediately after the disappearance of the signal F1 the signal F2 is received: A signal with L-level is applied to the NAND gate G1 of the IC8.

At the output of the fourfold NAND gate G1 of the IC8 in the digital logic part 224 a signal with Ø-level is generated when the four conditions are met as cited. From this signal with Ø-level the following inverter I3 generates a signal with L-level, that is a signal for igniting the ignition thyristor Thy1 of the detonator 238. This signal with L-level is fed to the gate electrode as an ignition electrode of the ignition thyristor Thy1, where it is additionally subjected to a coupling with the control signal RI from the inverter I1. The gate electrode is short-circuited during the control positioning time by the transistor T7, the base of which is controlled over a base voltage divider with two resistors R48 and R49.

For controlling the discharge thyristor Thy2 for the battery discharge, the following three conditions have to be met:

(a) The generation of the control signal is finished: A signal with L-level is present at the two first inputs of the NAND gate G2 of the IC8.

(b) The outputs Q1 and Q2 of the time base decoder IC4B carry a signal with Ø-level. The following NAND gate G3 in the IC8 generates therefrom a signal with L-level at the third input of the NAND gate G2, from which a following inverter I5 provides a signal with Ø-level for the fourfold NAND gate G1 of the IC8 at the third input of the same, and thereby blocks the two NAND gates G1 and G2 in the digital logic part against each other.

(c) The output Q3 if the time base decoder IC4B carries a signal with L-level, that is, it is $3.t_1$, in total the time $t_1+t_2$, passed since the point in time of switching on.

In this way at the output of the second NAND-gate G2 in the IC8 is present a signal with Ø-level, which is transformed to a signal with L-level by a following inverter I4 and is then employed for the ignition of the discharge thyristor Thy2 for the battery discharge.

Detonator Ignition Circuit

The output signal of the inverter I3 of the first driver stage 230 in the IC9 is fed to an RC-filter comprising a resistor R40 and a capacitor C28 for the discharge of interference peaks. The output signal of the inverter I3 controls then via a series resistor R44 and a diode operated in conductance direction D8 the gate electrode as ignition electrode of the ignition thyristor Thy1 in the ignition circuit of the detonator 238 directly. The power diode D8 brings into the circuit an additional safety threshold of about 0.65 V.

A capacitor C33 is connected on the anode side to the thyristor Thy1. The capacitor C33 is preferably a tantalum-electrolyte capacitor, which is charged by the battery 40 via the resistor R58 to the supply voltage $U_{batt}$. The anode of the ignition thyristor Thy1 takes the ignition current for the detonator 238 from this capacitor C33, where the capacitor C33 assures the required current pulse. The detonator 238 itself is in the cathode circuit of the ignition thyristor and is connected to ground. In parallel with the detonator 238 is situated a resistor R56 connected to ground for discharge of thyristor blocking currents, while the cathode of the thyristor Thy1 itself is connected to the test point MP9. The gate electrode of the thyristor Thy1 is connected to ground via a resistor R54 and a parallel thereto connected capacitor C32, in order to discharge positive interference peaks at the gate electrode of the ignition thyristor Thy1.

As mentioned above, the transistor T7 connected in parallel to the resistor R54 and the capacitor C32 provides a short-circuit function during the switch on transient of the circuit via the signal RI of the inverter I1 and assures the blockage of the ignition thyristor Thy1. The transistor T7 is connected with its emitter directly to ground, with its collector on the one hand directly to the gate electrode of the ignition thyristor Thy1 and on the other hand via the diode D8, the resistor R44 and the RC-section of resistor R40 and capacitor C22 to the output of the inverter I3.

Battery Discharge Circuit

The output signal of the inverter I4 of the second driver stage 232 in the IC9 runs similarly to the layout of the detonator ignition circuit through an RC-filter, which comprises the resistor R41 and the capacitor C29. The signal runs from there as an ignition pulse for the discharge thyristor Thy2 via a resistor R45 and a zener diode D7 to the gate electrode as an ignition electrode of the discharge thyristor Thy2, where the zener diode D7 with a zener voltage of 5.1 volts provides for a lifting of the thyristor ignition threshold.

The gate electrode of the discharge thyristor Thy2 is connected via a discharge resistor R47 to ground and parallel to the resistor R47 is provided a capacitor C31, preferably a tantalum electrolyte capacitor, for short circuiting possible interference peaks. The cathode of the discharge thyristor Thy2 is connected directly to ground in contrast to the cathode of the ignition thyristor Thy1 and the discharge thyristor Thy2 is mounted on a cooling body for better removal of the power dissipation occurring in the discharge thyristor Thy2.

The discharge of the battery 40 is performed via four resistors R50 to R53 connected in parallel, which have a total resistance of 11 ohms. The discharge thyristor Thy2 remains ignited and discharges the battery 40 with an initial discharge current in the ampere region. The remaining ignition circuit becomes currentless upon the ignition of the discharge thyristor Thy2, since simultaneously the fuse Si constructed as a slow fuse is melted through, via a series connection comprising a diode D9 and a resistor R55.

From the point in time of the closing of the switch 242 of the water pressure safety device the load resistor R57 provides for a constant load in order to not interrupt during the discharge phase the process of the battery discharge prematurely even when the maintaining current of the discharge transistor is falling short.

Mode of Operation

Figure 12:
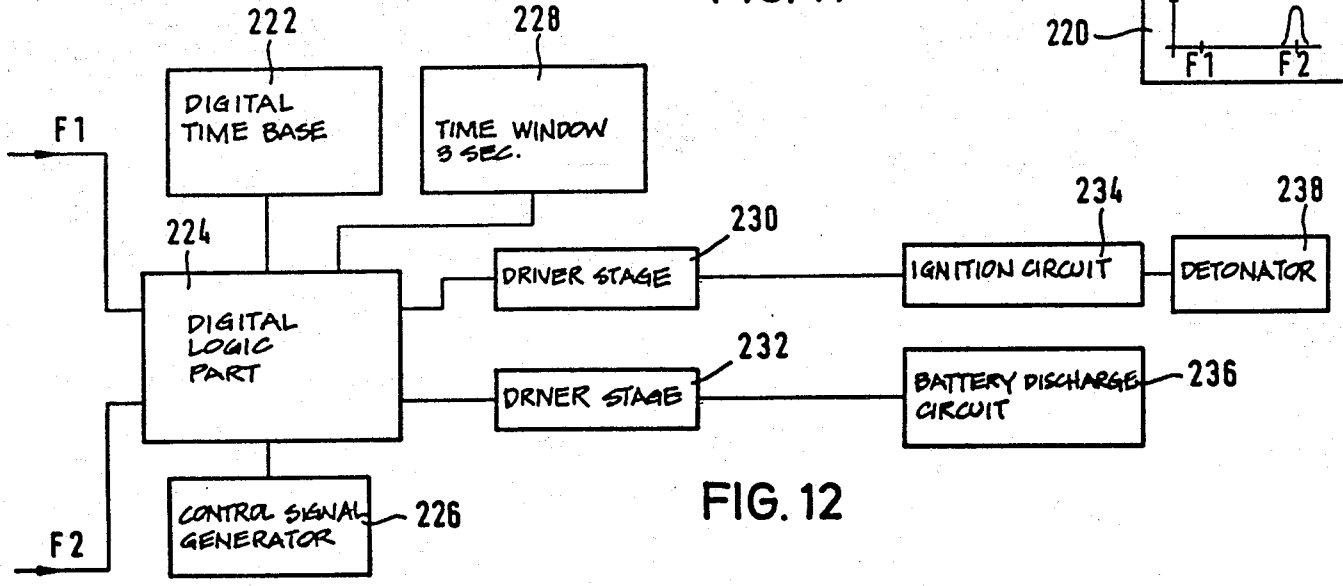
FIG. 12 is a block diagram for illustrating the signal flow in the ignition circuit of the invention referring in particular to the digital logic part.

As indicated in FIGS. 11 and 12, the signals are received by the hydrophone 210 and pass through the preamplifier 212, the band-pass filter 214, the buffer amplifier 216, as well as the two selective filters 218 and 220, which provide the two signals F1 and F2, which are further processed in the logic part as logical signals. The logic part comprises a control signal generator 226, a time window 228, as well as a digital time base 222, and further comprises the connecting and deciding logic. The control signal generator provides signals resulting in a proper initial setting of the logic elements upon switching on of the voltage. The connecting and deciding logic provides an output signal to the first driver stage 230 or to the second driver stage 232, which either ignites the detonator 238 via an ignition circuit or provides for the separation of the supply voltage or the discharge of the battery 40 in the discharge circuit 234 depending on the received input signals from the hydrophone 210. In practice, the above ignition circuit is connected through the switch 242 of the water pressure safety device to the battery 40 and thereby placed in operation when prior thereto the locking pin and the water pressure safety devices are released according to the sequence required by the device construction. As soon as this connection of the ignition circuit to the battery is performed, the dead time $t_1$ of the ignition device starts in order to allow that a mission vessel can remove itself without difficulty from the location of operation after having brought the explosive charge with the ignition device, since an ignition of the detonator is not possible during this time interval.

After this dead time $t_1$ the live time $t_2$ of the ignition circuit begins and during this time the ignition device can be ignited through coded signals with corresponding frequencies. The evaluation electronics of the ignition circuit recognizes and suppresses ship sounds and detonation sounds in or above water as noncoded signals. Therefore, in an operation region it is possible to work simultaneously with a multiplicity of ignitors with ignition circuits of this kind, since the ignition device code is provided differently in the evaluation electronic of the ignition circuits and since the emitter providing release pulses can be adjusted to the individual ignition device codes.

In case during the live time $t_2$, that is until the time $t_1+t_2$ from the begin of switching of the ignition circuit, no ignition signal appears then the battery 40 carried along in the ignition device is discharged with a discharge current in the ampere region via a discharge circuit with the thyristor Thy2. Simultaneously, the evaluation part of the ignition circuit, that is the analog part for the selection of the signals received, as well as the complete detonator ignition circuit is separated via the fuse Si from the battery 40, while the discharge thyristor Thy2 employed for discharging the battery 40 remains connected through even after the discharge time $t_3$. If the maintaining current of about 10 milliampere is falling short, then the discharge resistor R57 provides for a discharge of the battery until it is completely exhausted.

In the above disclosed ignition circuit there are preferably employed C-MOS devices, which have in fact a fairly slow switching behavior in the microsecond region, however which are for the present purposes completely sufficient and which in addition offer the advantage that they do not unnecessarily load the battery, since the individual devices practically only during the short time of switching for several microseconds pull any appreciable current.

Although the invention is illustrated and described with reference to a preferred embodiment thereof, it is to be expressly understood that it is in no way limited to the disclosure of such preferred embodiment, but is capable of numerous modifications within the scope of the appended claims.

TABLE 1

Truth Table for Input Decoder IC4A and Time Base Decoder IC4B

| E | F1 B | F2 A | Q3 | Q2 | Q1 | Q0 |
|---|---|---|---|---|---|---|
| 0 | L | L | L | 0 | 0 | 0 |
| 0 | 0 | L | 0 | 0 | L | 0 |
| 0 | L | 0 | 0 | L | 0 | 0 |
| 0 | 0 | 0 | 0 | 0 | 0 | L |
| L | X | X | 0 | 0 | 0 | 0 |

TABLE 2

Frequencies and Times Relating to the Divider Chain

| Divider/ Output | Oscillator frequency and Division | Result | Application |
|---|---|---|---|
| IC6/Q13 | 18641 Hz: $2^{13}$ | 2.2755 Hz | Time window of 3 seconds |
| IC7/Q11 | 18641 Hz: $2^{25}$ | $5.554.10^{-4}$Hz | Live time, |
| IC7/Q12 | 18641 Hz: $2^{26}$ | $2.7777.10^{-4}$Hz | Discharge |

TABLE 3

Timc Ranges at the Output of the Time Base Decoder

| Region | Decoder Input B = Q12 | Decoder Input A = Q11 | "L" at Decoder Output | Coup-ling/Ap-plication | Meaning |
|---|---|---|---|---|---|
| $t_1$ | Ø | Ø | Q0 | none | "Dead time" |
| $t_2$ | Ø | L | Q1 | NOR-function | "Live time" |
| | L | Ø | Q2 | NOR function | |
| $t_3$ | L | L | Q3 | NAND-function | Blocking of ignition, release of "discharge" of battery = ignition of the discharge thyristor Thy2 |

We claim:

1. Control system for sound actuation of. ignition devices, comprising:

a digital logic part;

means producing two frequency and time correlated input signals;

an analog pressure wave receiver comprising a hydrophone, a preamplifier connected to said hydrophone, a band-pass filter connected to said preamplifier, a buffer amplifier connected to said band-pass filter, and two parallel selective filters connected to said buffer amplifier and having outputs with logic level for processing in said digital logic part;

said digital logic part connected to said analog pressure wave receiver;

dual driver stages connected to said digital logic part; and first and second discharge circuits connected in parallel, said first discharge circuit connected to the dual driver stages and to a detonator and a voltage supply and suitable for selectively igniting the detonator and the second discharge circuit for short circuiting the voltage supply, and wherein said digital logic part activates said first and second discharge circuits in successive time intervals ($t_1$, $t_2$, $t_3$) depending on said means producing two frequency and time correlated input signals; and said two parallel selective filters comprise in their filter channel in each case in series connection a filter element, an emitter follower and a Schmitt-trigger.

2. The control system according to claim 1, wherein the selective filters are decoupled via two resistors and are provided with piezoelectrical tuning fork filters capable of maintaining the impressed resonance frequency to 1 hertz accuracy.

3. The control system according to claim 1, wherein the digital logic comprises:

a control signal generator for zero positioning of the time switching;

a digital time base for generating a timme dependent pulse;

a time window for scanning of time and frequency correlated, coded receiver signals; and output stages comprising said dual parallel driver stages which in each case selectively control a thyristor for igniting the detonator or for separating the supply voltage and for discharging the battery.

4. The control system according to claim 3, wherein the digital logic part comprises:

a divider; and a connecting logic connected to the divider for successively in a first time interval ($t_1$) blocking two discharge units, in a second time interval ($t_2$) releasing a detonator ignition circuit and blocking a battery discharge circuit, and in a third time interval ($t_3$) separating the detonator ignition circuit and the analog receiver part and discharging the battery.

5. The control system according to claim 4, wherein the ignition circuit is connected through a switch of a water pressure safety device to the supply voltage, and wherein upon closure of the switch the digital logic part takes a defined starting state and begins a dead time in the first time interval ($t_1$).

6. The control system according to claim 5, wherein the outputs of the digital logic part are connected in each case with a gate electrode of thyristors and these connect through in the presence of a predetermined output signal.

7. The control system according to claim 6, wherein the gate electrode of the ignition thyristor for the detonator is connected to a transistor, which at the switch-on time of the ignitor forms a short circuit bridge and thus excludes a connecting through of the ignition thyristor.

* * * * *